US012084818B2

(12) United States Patent
McDaniel

(10) Patent No.: US 12,084,818 B2
(45) **Date of Patent: *Sep. 10, 2024**

(54) TRANSPORTATION PATHWAY ELEVATION SEPARATOR

(71) Applicant: Gevin Joseph McDaniel, Tallahassee, FL (US)

(72) Inventor: Gevin Joseph McDaniel, Tallahassee, FL (US)

( * ) Notice: Subject to any disclaimer, the term of this patent is extended or adjusted under 35 U.S.C. 154(b) by 248 days.

This patent is subject to a terminal disclaimer.

(21) Appl. No.: 17/652,690

(22) Filed: Feb. 27, 2022

(65) Prior Publication Data

US 2022/0195676 A1 Jun. 23, 2022

Related U.S. Application Data

(63) Continuation of application No. 17/407,906, filed on Aug. 20, 2021, now Pat. No. 11,293,151.

(60) Provisional application No. 63/128,658, filed on Dec. 21, 2020.

(51) Int. Cl.
*E01D 15/12* (2006.01)
*E01D 15/133* (2006.01)

(52) U.S. Cl.
CPC ..... *E01D 15/124* (2013.01); *E01D 15/133* (2013.01)

(58) Field of Classification Search
CPC ..... E01D 15/124; E01D 15/133
USPC ..... 14/2.4, 69.5
See application file for complete search history.

(56) References Cited

U.S. PATENT DOCUMENTS 4,123,912 A * 11/1978 Meldrum ..... E02B 3/068 14/71.1
5,682,635 A * 11/1997 Tolliver ..... E04C 5/165 404/1
5,846,020 A * 12/1998 McKeown ..... E01C 1/002 404/1
6,446,292 B1 * 9/2002 Fuessinger ..... E01D 15/133 14/2.4
7,160,055 B2 * 1/2007 Beamish ..... E01C 9/08 404/34
7,334,963 B2 * 2/2008 Costa ..... E01C 11/14 14/73.1
9,279,221 B1 * 3/2016 Orona ..... E01D 15/124
2002/0170259 A1 * 11/2002 Ferris ..... E04F 11/116 52/586.1
2009/0007348 A1 * 1/2009 Woodmansee, III ..... E01D 15/124 182/21

(Continued)

*Primary Examiner* — Raymond W Addie

(57) ABSTRACT

A modular system for constructing an elevated pathway includes a first pathway segment comprising a first elevated platform portion; first edge supports to bare a load of the first elevated platform portion, wherein the first edge supports contact a ground surface and create a grade separation between the ground surface and a bottom side of the first elevated platform portion; and a first joint. The modular system also includes a second pathway segment comprising: a second elevated platform portion; second edge supports to bare a load of the second elevated platform portion, wherein the second edge supports contact the ground surface and create a grade separation between the ground surface and a bottom side of the second elevated platform portion; and a second joint to attach to the first joint to limit a motion of the second pathway segment relative to the first pathway segment.

20 Claims, 28 Drawing Sheets

(56) References Cited

U.S. PATENT DOCUMENTS

2010/0281635 A1* 11/2010 Hemby ..... E01D 15/133
14/73.1
2014/0161525 A1* 6/2014 Smith ..... E01C 5/18
404/41
2014/0345069 A1* 11/2014 Tirimanna ..... E01D 19/103
14/73.1

* cited by examiner

TRANSPORTATION PATHWAY ELEVATION SEPARATOR

This application is a continuation of U.S. Non-Provisional patent application Ser. No. 17/407,906, filed Aug. 20, 2021, which claims the benefit of U.S. Provisional Patent Application 63/128,658, filed Dec. 21, 2020, the entire content of both being hereby incorporated by reference.

TECHNICAL FIELD

This disclosure relates to a modular system for constructing elevated pathways.

BACKGROUND

Pathways, such as sidewalks, may be temporarily closed during construction for various reasons. One reason may be that the materials used for the construction of pathways require curing times where the pathway is not immediately useable.

SUMMARY

A transportation path elevation separator (TPES) as described in this disclosure may be placed along a pathway under construction in the same vertical plane as the pathway to allow road users walking or riding bicycles, scooters, wheelchairs, or other types of micro-mobility devices to use the pathway without interfering with the construction activity and materials of the path.

In one example, a modular system for constructing an elevated pathway includes a first pathway segment comprising a first elevated platform portion; first edge supports configured to bare a load of the first elevated platform portion, wherein the first edge supports are configured to contact a ground surface and to create a grade separation between the ground surface and a bottom side of the first elevated platform portion; and a first joint. The modular system also includes a second pathway segment comprising: a second elevated platform portion; second edge supports configured to bare a load of the second elevated platform portion, wherein the second edge supports are configured to contact the ground surface and to create a grade separation between the ground surface and a bottom side of the second elevated platform portion; and a second joint configured to attach to the first joint to limit a motion of the second pathway segment relative to the first pathway segment.

The details of one or more examples are set forth in the accompanying drawings and the description below. Other features, objects, and advantages will be apparent from the description, drawings, and claims.

BRIEF DESCRIPTION OF DRAWINGS

FIG. 1*a* also shows existing ground adjacent to the sidewalk.

FIG. 2*a*-2 illustrates a perspective view of an example off-ramp terminus segment.

FIG. 2*a*-3 illustrates a perspective view of the underside and opposing end of an example on-ramp terminus segment of FIG. 2*a*-1.

FIG. 2*b*-1 illustrates a perspective view of an example on-ramp transition segment.

FIG. 2*b*-2 illustrates perspective view of an example off-ramp transition segment.

FIG. 2*b*-3 illustrates a perspective view of the underside and opposing end of an example on-ramp transition segment of FIG. 2*b*-1.

FIGS. 6*b*-1 to 6*b*-3 illustrate example configurations of deck panels, joints, and joint adapters to create the composite deck for various segment types.

FIGS. 6*c*-1 to 6*c*-4 illustrate example ranges of motion of an example rounded finger joint to accommodate vertical deflections between segments.

DETAILED DESCRIPTION

Figure 1A:
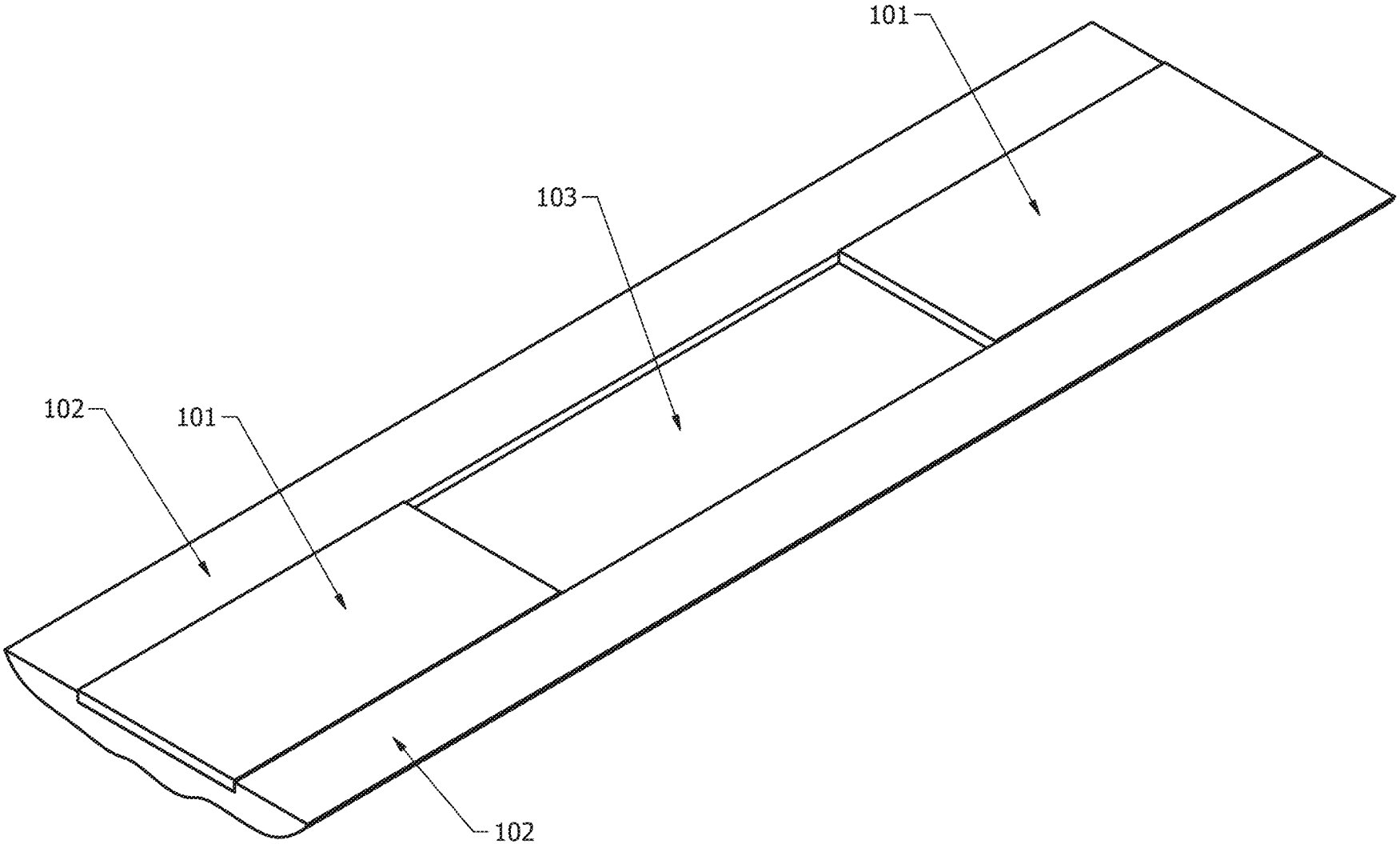
FIG. 1*a* illustrates a common condition where a section of sidewalk is removed with the intention of reconstructing the section.

Under current practice, during closure times for pathways, users are typically detoured or diverted onto different pathways. With restricted right-of-way, many times the users may be detoured significantly to the point that they choose shorter, less safe routes not intended to be used. Currently, there is no available option to enable the users to travel along an elevated pathway directly above the existing pathway while allowing the progression of construction activities. This disclosure describes a system that may be beneficial to project costs, mobility of the users, and safety of the users.

The transportation path elevation separator (TPES) described herein may be implemented in many different ways depending on the type of path, the materials used for fabrication of the TPES, and the tooling capabilities of the fabricator. One specific implementation is shown in the Figures, but it should be apparent that other implementations are also within the scope of this disclosure. The following is a detailed description of an example implementation for a TPES.

The Figures illustrate one specific application of the TPES showing how the various sections may be assembled to provide a pathway over an existing concrete sidewalk where a section of the sidewalk is removed for reconstruction. Although the use for concrete sidewalk construction is specifically mentioned, as discussed further below, the use of the TPES is not limited to applications for sidewalk construction. It is contemplated, however, the TPES described in this disclosure may be used to provide pathways on other types of temporary or permanent public or private facilities for other disruptive conditions such as utility operations and flooded areas or for providing pathways where the existing ground is desired to remain undisturbed beneath the pathway. The system may also be configured to allow a user to create a new pathway through or around construction zones. It is also contemplated that the TPES may be supplemented with support beams or girders beneath the system to span over obstacles such as ditches to provide an accessible pathway bridge in permanent or temporary conditions.

The safety of road users such as pedestrians and bicyclists is one of the top priorities with transportation agencies all over the world. Sidewalks and shared use paths are used on the transportation system to provide for modes of transportation such as walking or riding bicycles, scooters, wheelchairs, or other types of micro-mobility devices. With the Americans with Disabilities Act (ADA) requirements, transportation agencies are required to provide similar facilities during construction activities to allow Americans with disabilities to safely travel through and around construction zones. With limited right-of-way, it is often challenging to find the space during construction activities to place alternate paths for these modes of travel.

When a pathway is constructed or reconstructed, some paving materials must cure for a period prior to opening to traffic. Although the actual active construction time may be relatively short, these pathways often must be closed for a much longer duration to allow for curing of these materials. Currently, the road users must be detoured or diverted to alternate paths which require temporary paths and signing which likely take the user longer to navigate. Many users that encounter these conditions choose to take their own, less safe routes to their destinations. While the laws require these paths to remain open, there is currently not an adequate way to ensure having the paths remain open can practicably be accomplished with the limited right-of-way and funding. Currently, there is no available option to enable the users to travel along a modular elevated pathway directly above the existing pathway. Often, the owners of the facility such as state and local transportation agencies allow exceptions to keeping the pathways open because there is no current practicable alternative. The TPES system of this disclosure potentially helps promote compliance with the applicable federal laws. Thus, the system of this disclosure may be beneficial to project costs, mobility of the users, and safety of the users.

A modular system for constructing an elevated pathway as described herein may provide a way to maintain an accessible pathway along the same centerline of a pathway below the system without disturbing the existing pathway or surface. That is, in some use cases, instead of having to reroute traffic, e.g., pedestrian or bike traffic, while an existing pathway is under construction, the modular system described herein may allow for traffic to follow the same route, while still preventing pedestrians or light vehicles from damaging the existing pathway. The modular system described herein may be easy and quick to install, portable, stackable, and reusable. Using the modular system described herein, pedestrians, may be able to use the same right-of-way space as an existing pathway, while a portion of that existing pathway is temporary unavailable, due to repairs for instance. Moreover, the modular system herein may not disturb the portion of the exiting pathway and may even protect uncured paving materials such as concrete from damage or graffiti. As explained in greater detail below, the modular system described herein may additionally include features to keep outside moisture, such as rain, away from the existing pathway, while still allowing proper conditions to promote curing.

A modular system for constructing an elevated pathway as described herein may include openings on the sides to allow for airflow, water to evaporate, and heat to dissipate. A modular system for constructing an elevated pathway as described herein may also protect an existing pathway by, for example, protecting the pathway from rain and sun, protecting the pathway from graffiti or other vandalism, and prevent tampering with curing blankets or other materials.

FIG. 1*a* illustrates a common condition where a section 103 of sidewalk 101 is removed with the intention of reconstructing the section 103 previously removed. This condition shows existing ground 102 adjacent to the sidewalk.

Figure 1B:
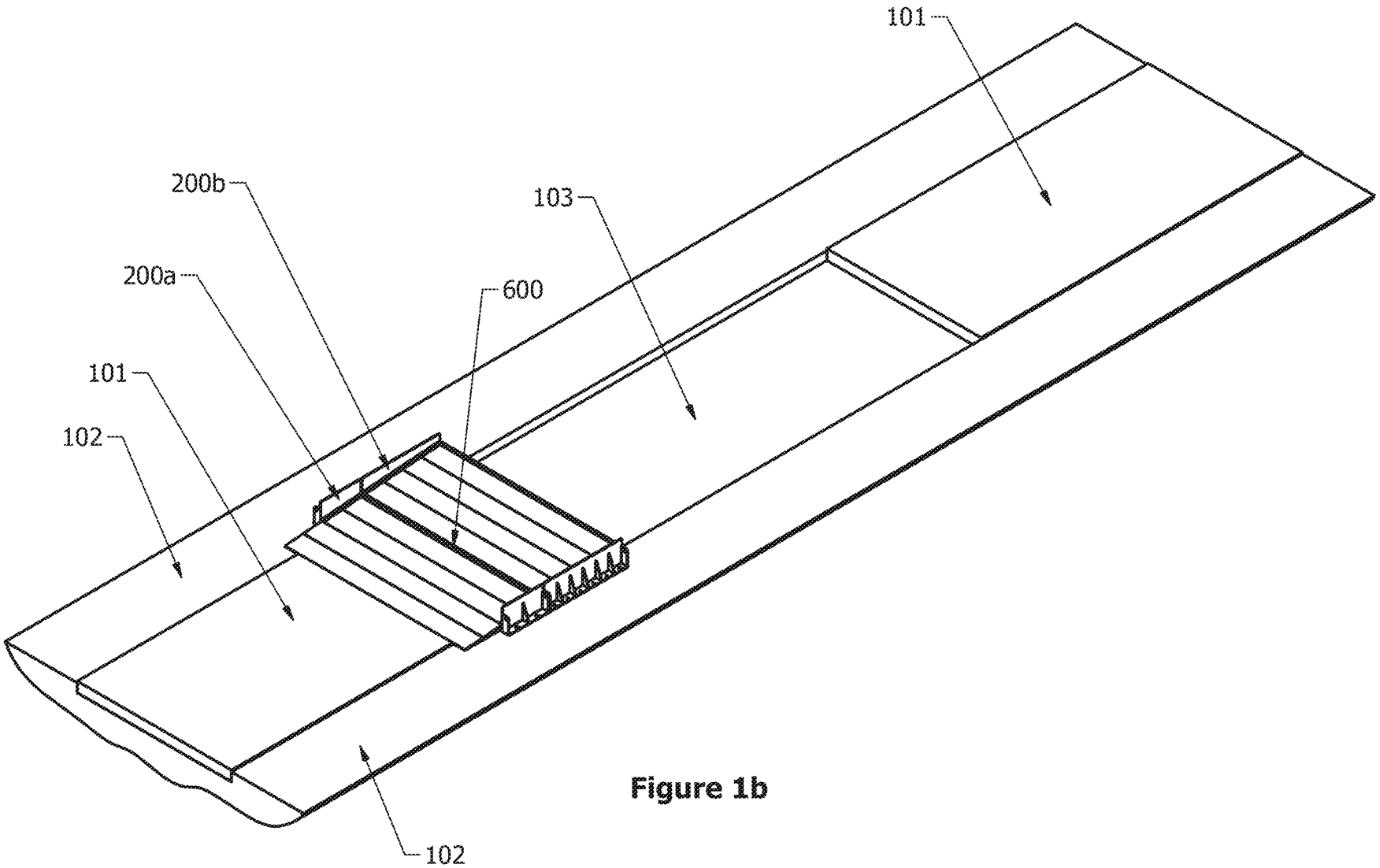
FIG. 1*b* illustrates the placement of example on-ramp segments.

FIG. 1*b* illustrates the placement of on-ramp terminus segment 200*a* and on-ramp transition segment 200*b*. In the example of FIG. 1*b*, on-ramp terminus segment 200*a* and on-ramp transition segment 200*b* are shown as being connected by a joint 600, but in other examples, these two segments may be connected in some other manner or may be implemented as a single segment. Additionally, in some examples, the system may utilize more than one transition segment.

Figure 1C:
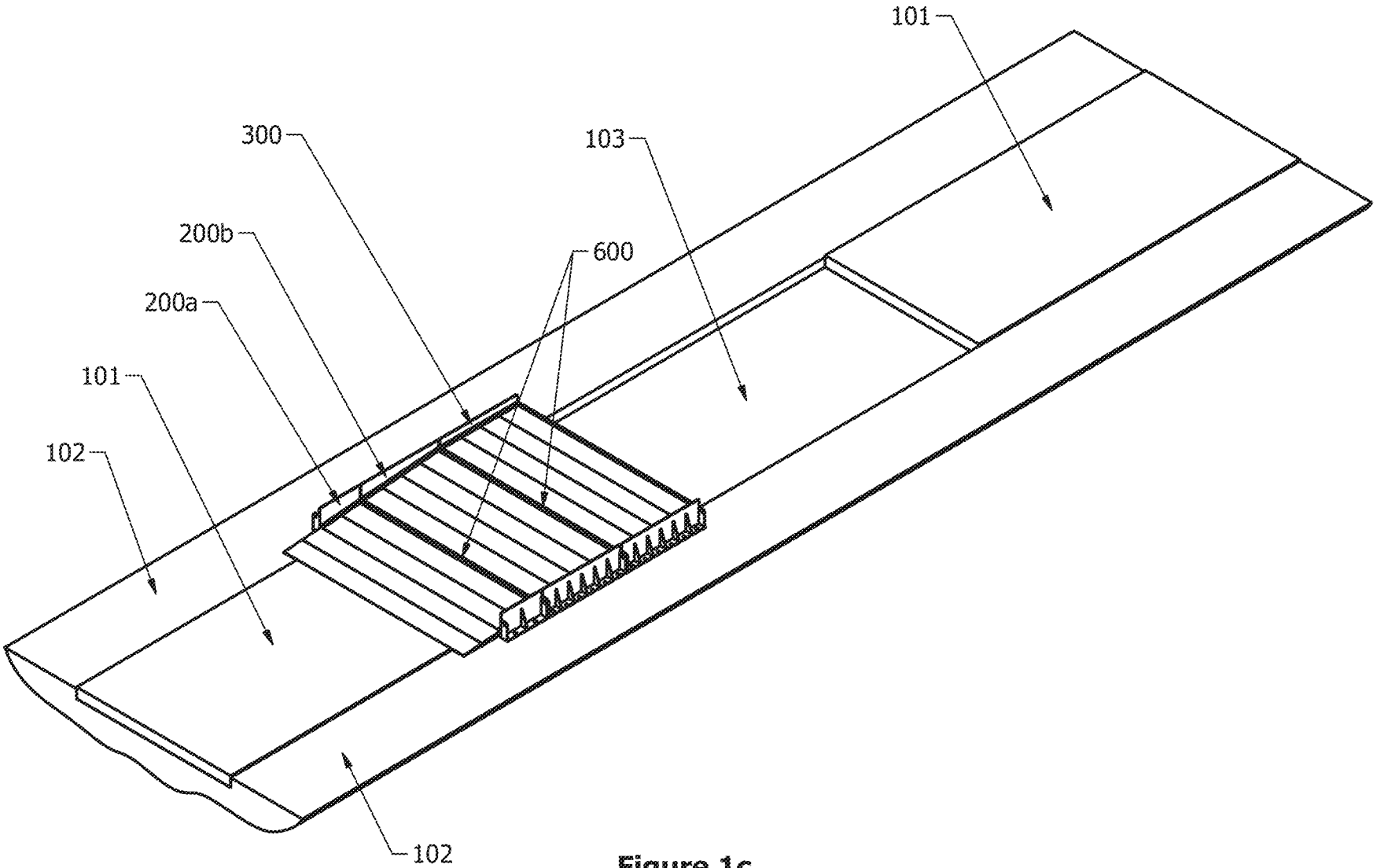
FIG. 1*c* illustrates the placement of an example first standard segment.

FIG. 1*c* illustrates the placement of a first standard segment 300. The segments are connected by a joint 600, but in other examples, these segments may be connected in some other manner or may be implemented in a combined segment.

Figure 1D:
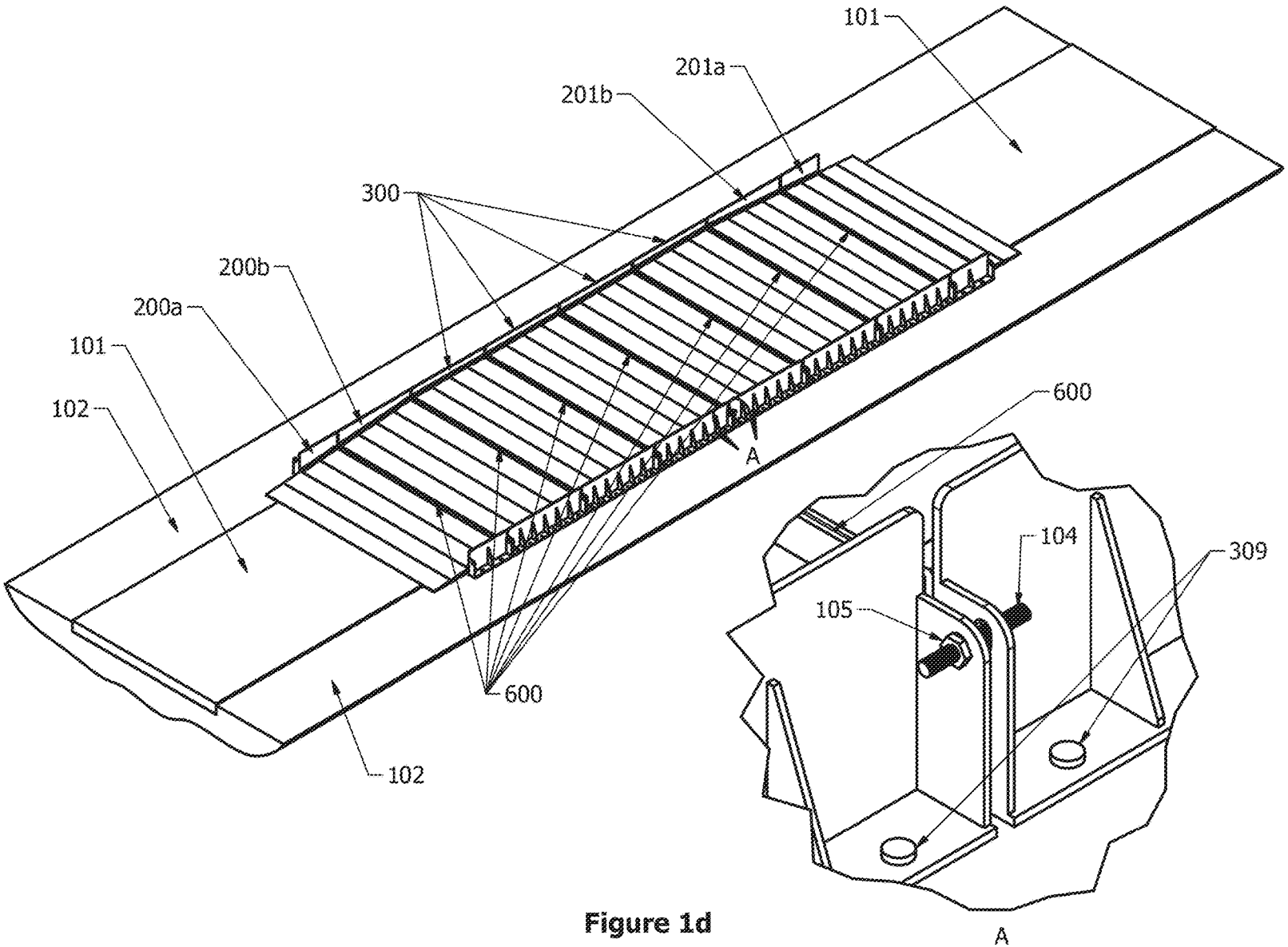
FIG. 1*d* illustrates the placement of remaining example standard segments and example off-ramp segments to complete a transportation pathway elevation separator (TPES) system.

FIG. 1*d* illustrates the placement of additional standard segments 300 and an off-ramp transition segment 201*b* and off-ramp terminus segment 201*a* to complete the TPES. The segments are connected by a joint 600. It should be understood that the terms "on-ramp" and "off-ramp" are being used herein to aide in the description of the TPES system. It is contemplated that on-ramp segments 200*a* and 200*b* and off-ramp segments 201*a* and 201*b* may each be used for both getting on and getting off the TPES system. In some implementations, on-ramp segments and off-ramp segments may essentially be identical, while in other implementations on-ramp segments and off-ramp segments may have some differences such as a different arrangement or different orientations for various connectors and the like.

Any or all of segments 200*a*, 200*b*, 201*a*, 201*b*, or 300 may be connected by any type of bolt and nut combination such as the example coil bolt 104 and coil nut 105 as illustrated in Detail A. Any or all segments may be connected to the bearing surface (e.g., a portion of existing ground 102) by anchors 309. The deck surface of all segments may include slip resistance, if desired for the application, which can be achieved in various ways depending on the materials and processes used for fabrication. One implementation of including slip resistance to the deck surface is to knurl the deck surface which comprises pointed profiles protruding from the deck surface that are notched transversely to the pointed protruding profiles, as will be discussed in more detail with respect to FIGS. 5*a*, 5*b*, and 5*c*. Another implementation for including slip resistance to the deck surface is including a deck coating comprised of a polymer and sand mixture to produce a desired friction coefficient. Another implementation for polymeric construction is to include a roughened deck surface in the segment mold to produce the desired friction coefficient. Another implementation for an aluminum construction is to sand blast the deck surface after fabrication to produce the desired friction coefficient. It is contemplated that there are many other solutions for obtaining slip resistance such as the application of slip resistant tape. Any of these surfaces may be colored to highlight the pathway for the visually impaired.

Figure 1E:
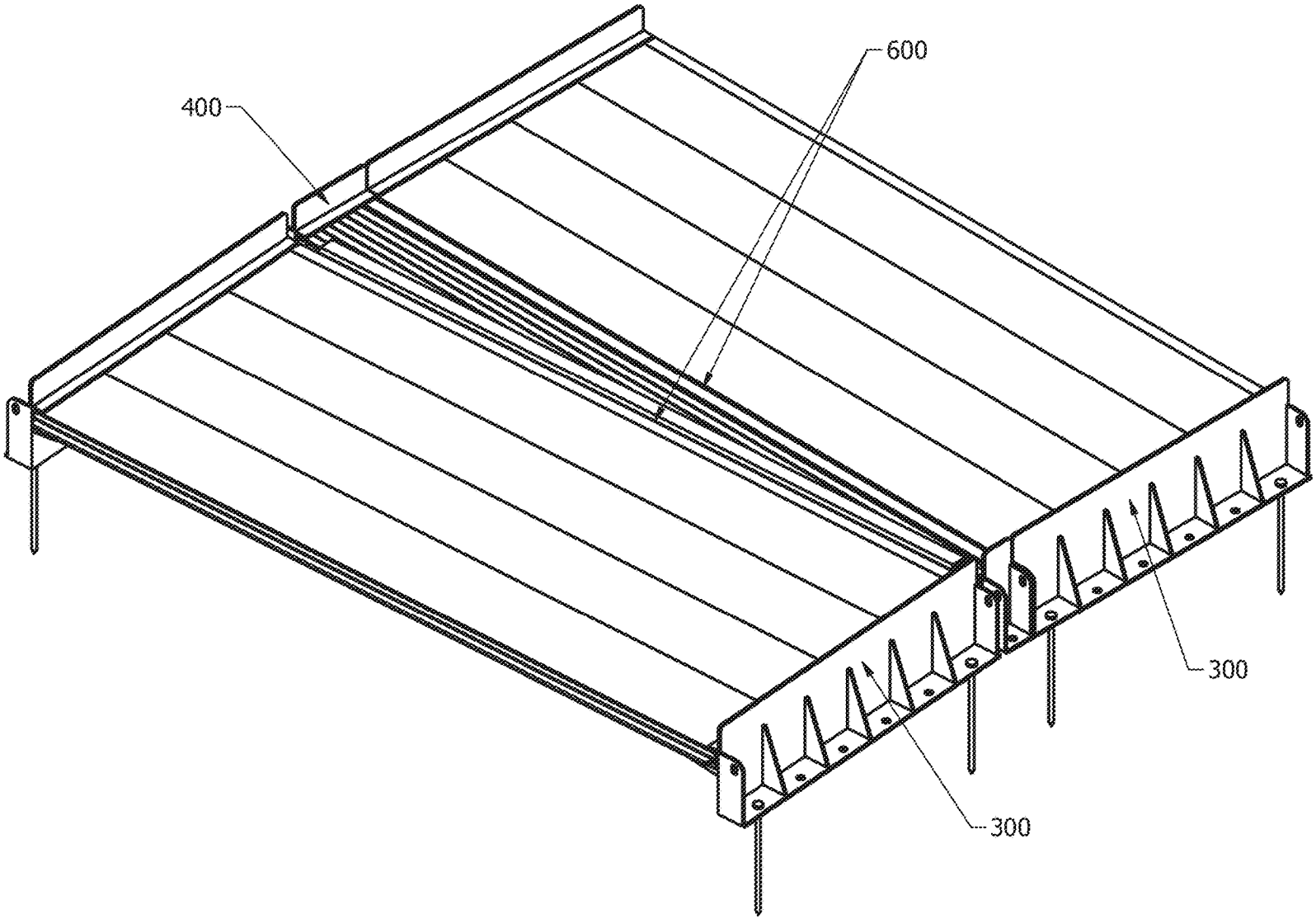
FIG. 1*e* illustrates accommodations for conditions with significant non-linear horizontal geometry using a radial segment.

FIG. 1*e* illustrates an example technique for providing accommodations for conditions with non-linear horizontal geometry. It is contemplated that other techniques such as adjustable, fanning or accordion-style, segments may also be used to accommodate various geometric conditions. FIG. 1*e* shows a radial segment 400 placed between two standard segments 300 to accommodate the change in horizontal alignment. The segments are connected by a joint 600. Radial segments may be proportioned to create various degrees of curvature to the pathway and provide for both left-turning and right-turning horizontal geometry.

Figures 1, 2A:
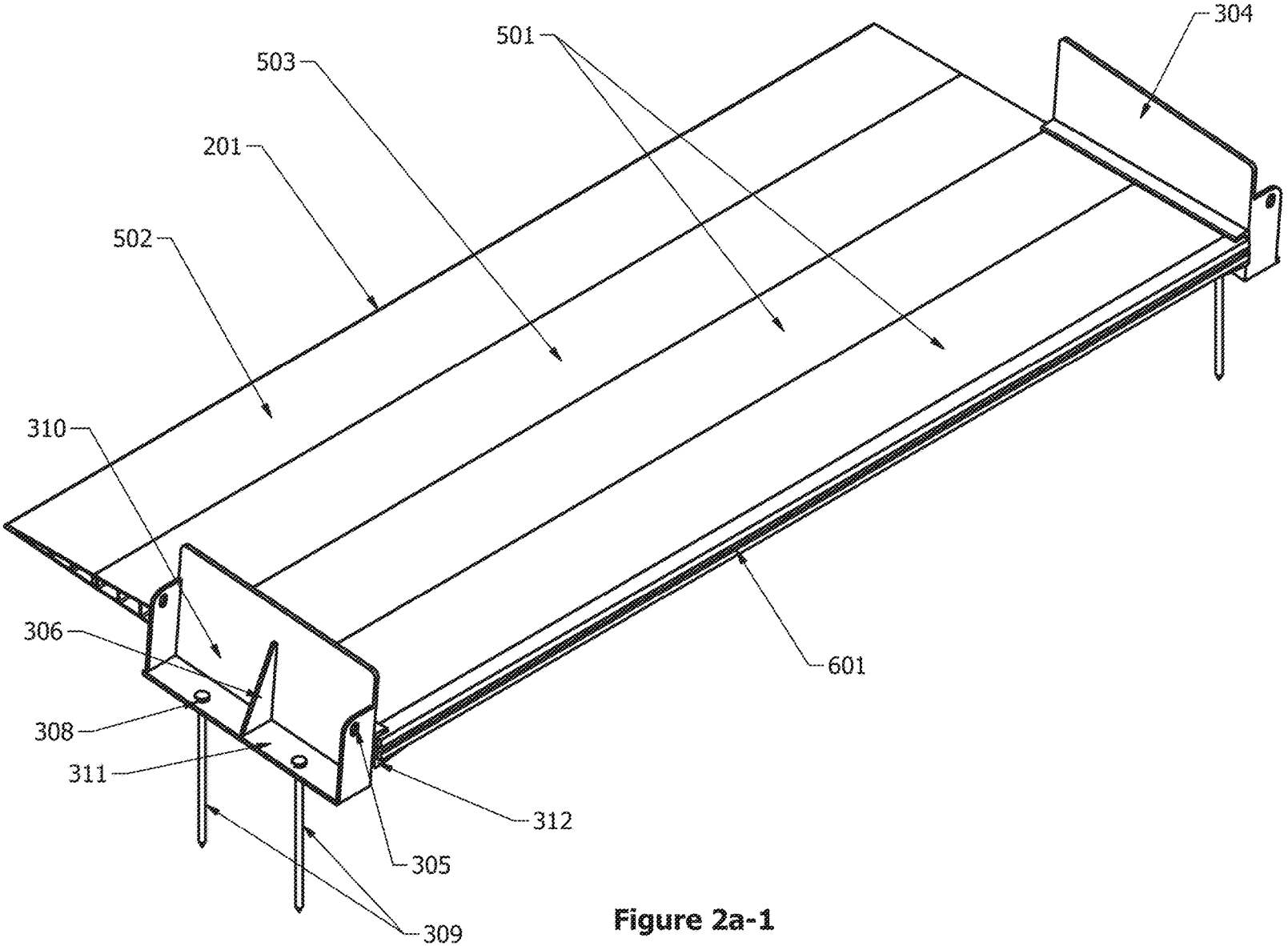
FIG. 2*a*-1 illustrates a perspective view of an example on-ramp terminus Segment.

FIG. 2*a*-1 illustrates a perspective view of the on-ramp terminus segment 200*a*. A deck may be sloped to meet the ADA standards for curb ramps. The surface details are not shown in this figure for clarity. An example treatment to achieve slip resistance may be seen in FIGS. 5*a*, 5*b*, and 5*c* describing the deck sections. The deck comprises standard deck sections 501, ramp landing deck section 503, ramp terminus deck section 502, and female rounded finger joint (FRFJ) 601. The ramp landing deck section may be configured to be supported by the at-grade surface. The ramp landing deck section 503 may be comprised of multiple sub-sections as needed to accommodate various ramp grades. The ramp terminus deck section 502 transitions the deck surface to the at-grade surface. The standard deck sections 501 are supported by the vertical wall supports comprising supporting mechanisms such as the example deck support channel 312. The edge 201 of the ramp terminus deck section may be beveled or rounded to meet ADA standards. A FRFJ 601 can be configured to accommodate connection to adjacent segments, such as on-ramp transition segment 200*b*, while transferring vertical load across the joint and allowing vertical deflections and slight horizontal deflections between segments to accommodate changes in vertical and horizontal geometry of the pathway. A curb 304 is located on each side of the path to accommodate ADA standards, provide detectable edges, and prevent users in wheelchairs or other devices from departing the pathway. Each curb 304 contains connection flange 305 to accommodate various connection methods and lifting devices if needed. External stiffeners 306 provide for load distribution and stiffen the vertical wall supports 310 and bottom flanges 311. The curb 304 and vertical wall supports 310 may comprise the same member as shown in this example. Anchor holes 308 may be spaced along bottom flange 311 to provide for anchors 309 at needed intervals. Multiple anchor holes 308 may be provided to allow variations in placement of anchors 309 to avoid items conflicting with anchorage such as utility pull boxes.

Although these figures show anchors 309 as stakes to be driven into the surface, other types of anchors may be used, such as screws, expansion anchors, clips, lag bolts, pins, or other devices.

Figures 2, 2A:
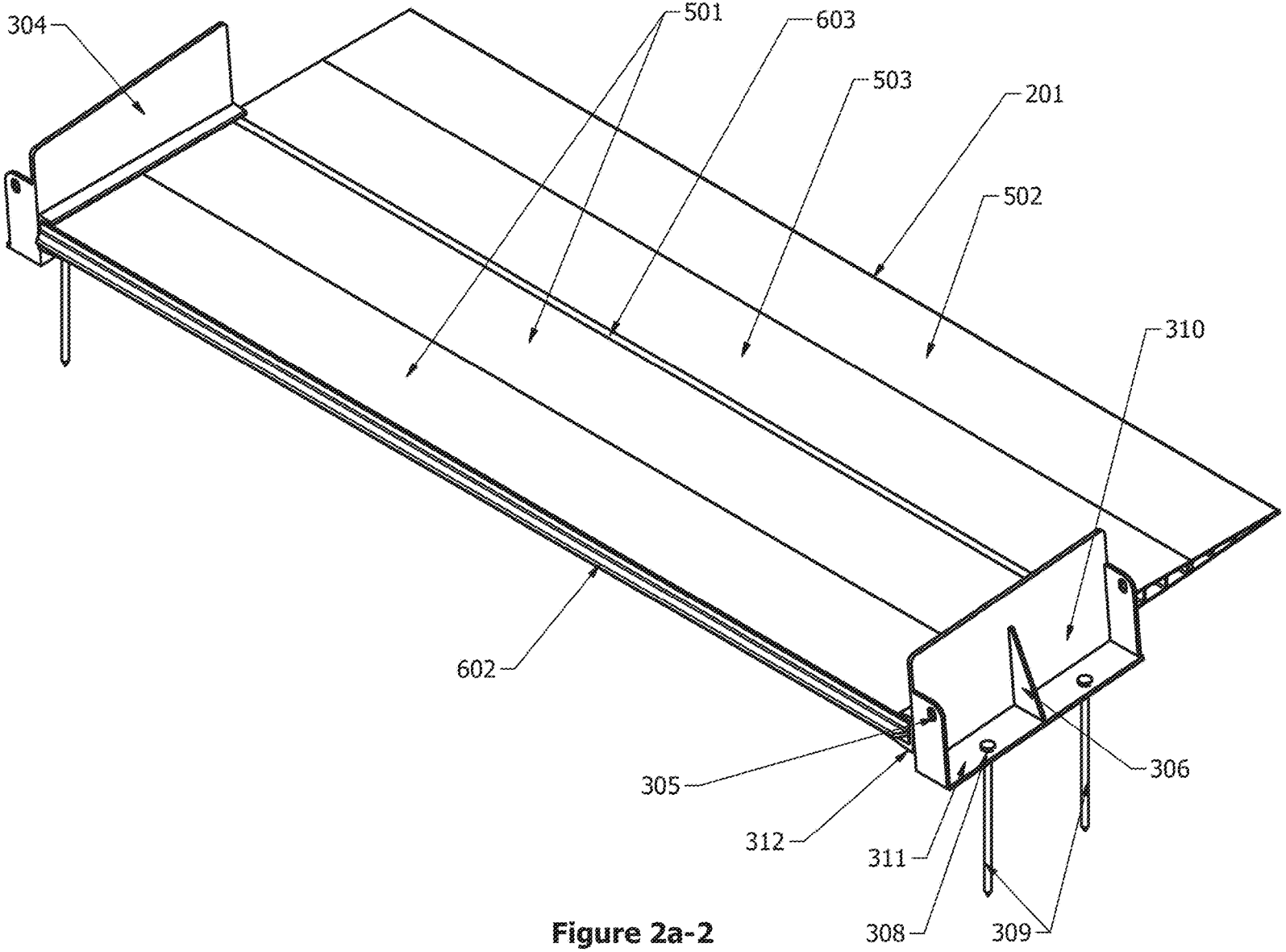

FIG. 2*a*-2 illustrates a perspective view of the off-ramp terminus segment 201*a*. A deck may be sloped to meet the ADA standards for curb ramps. The slip resistant surface is not shown in this figure for clarity. An example treatment to achieve slip resistance may be seen in FIGS. 5*a*, 5*b*, and 5*c* describing the deck sections. The deck comprises standard deck sections 501, joint adapter 603, ramp landing deck section 503, ramp terminus deck section 502, and male rounded finger joint (MRFJ) 602. The joint adapter 603 allows conversion for connectivity of male to female connectors, such that two male pieces can be connected via joint adapter 603. The ramp landing deck section may be configured to be supported by the at-grade surface. The ramp landing deck section 503 may be comprised of multiple sub-sections as needed to accommodate various ramp grades. The ramp terminus deck section 502 transitions the deck surface to the at-grade surface. The standard deck sections 501 are supported by the vertical wall supports comprising supporting mechanisms such as the example deck support channel 312. The edge 201 of the ramp terminus deck section may be beveled or rounded to meet ADA standards. A MRFJ 602 can be configured to accommodate connection to adjacent segments, such as on-ramp transition segment 201*b*, while transferring vertical load across the joint and allowing vertical deflections between segments to accommodate changes in vertical geometry of the pathway. A curb 304 is located on each side of the path to accommodate ADA standards, provide detectable edges, and prevent users in wheelchairs or other devices from departing the pathway. Each curb 304 contains connection flange 305 to accommodate various connection methods and lifting devices if needed. External stiffeners 306 provide for load distribution and stiffen the vertical wall supports 310 and bottom flanges 311. The curb 304 and vertical wall supports 310 may comprise the same member as shown in this example. Anchor holes 308 may be spaced along bottom flange 311 to provide for anchors 309 at needed intervals. Multiple anchor holes 308 may be provided to allow variations in placement of anchors 309 to avoid items conflicting with anchorage such as utility pull boxes.

Figures 2, 2A, 3:
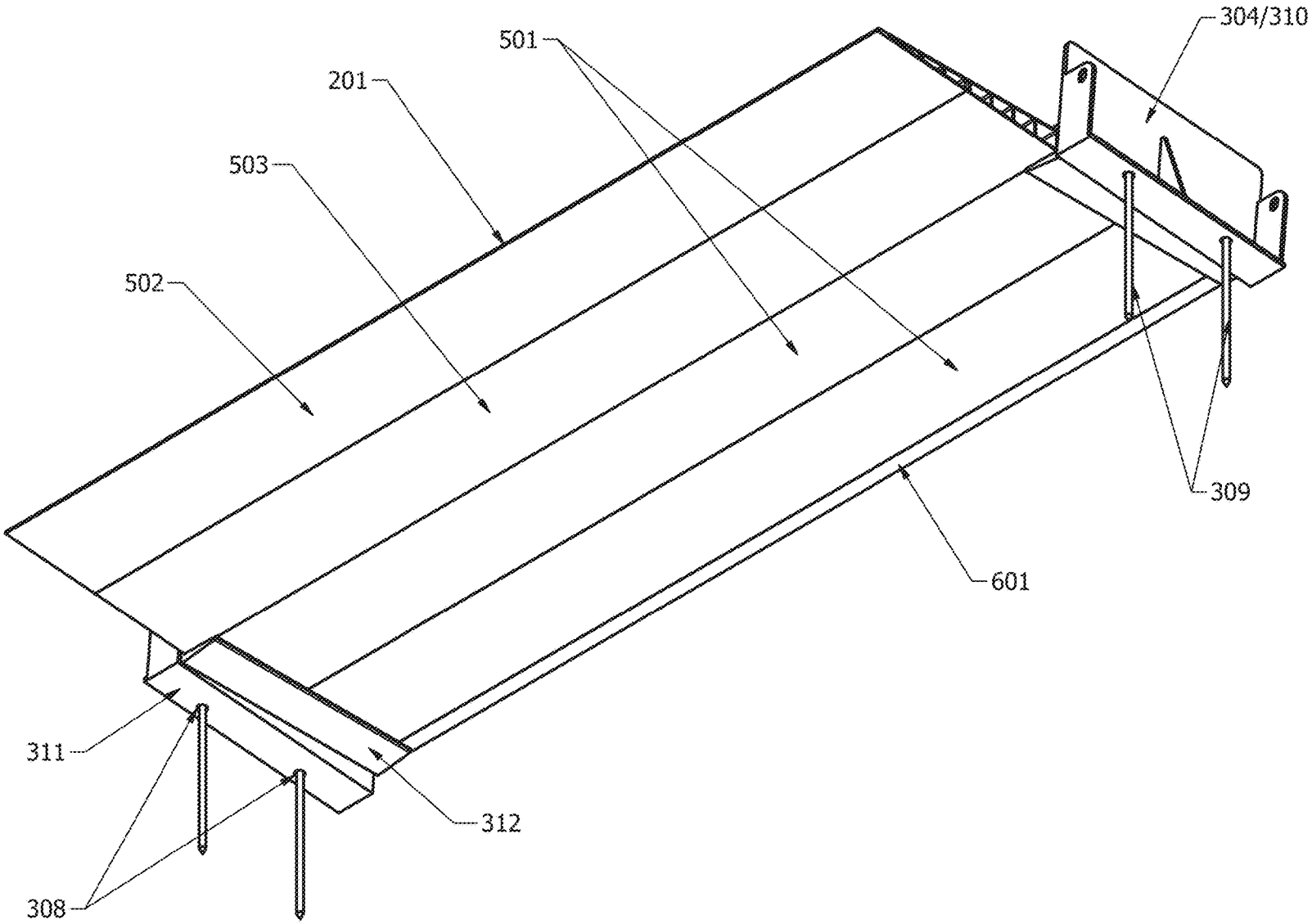

FIG. 2*a*-3 illustrates a perspective view of the underside and opposing end of an example on-ramp terminus segment of FIG. 2*a*-1.

Figures 1, 2B:
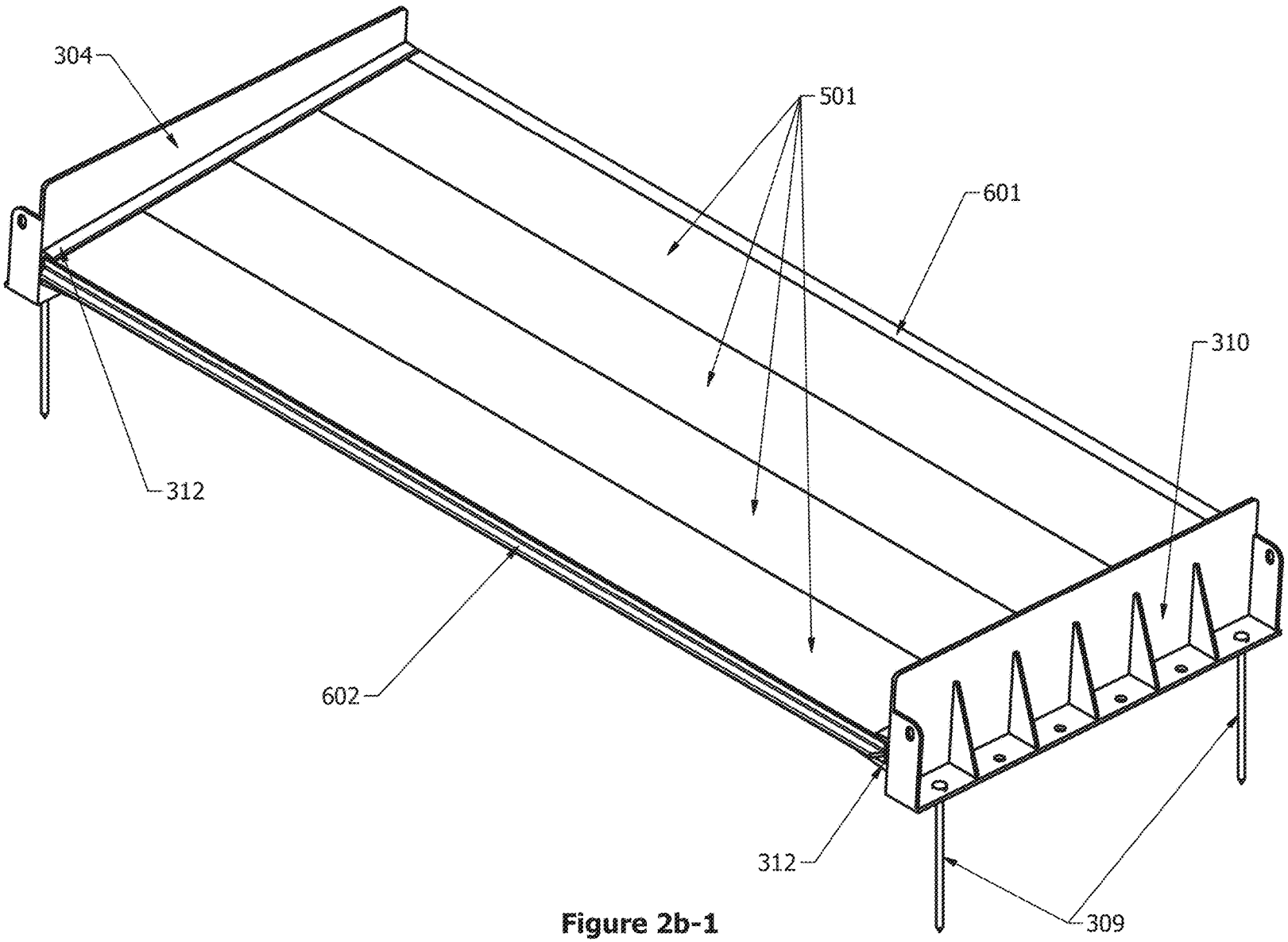
Figures 2, 2B:
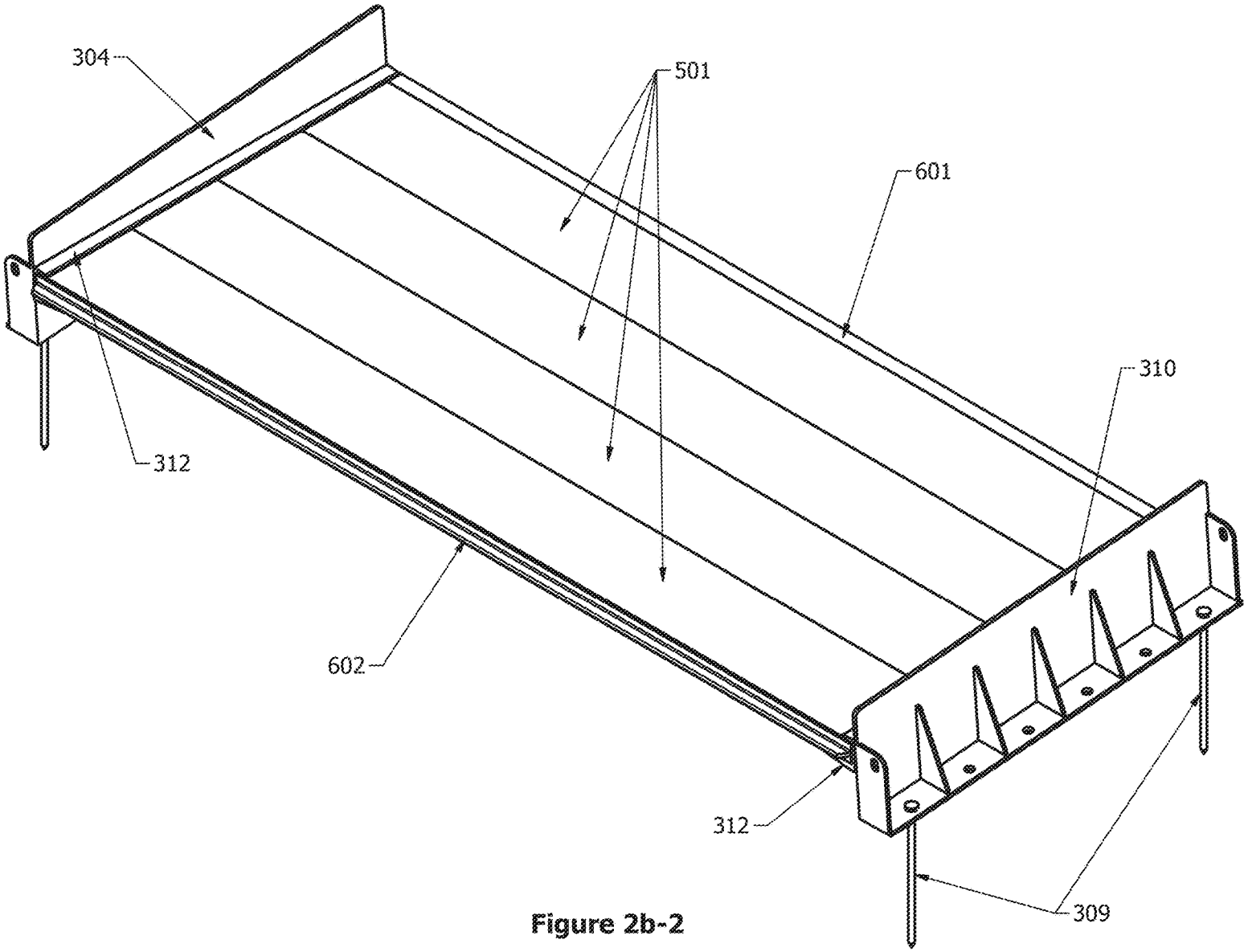
Figures 2, 2B, 3:
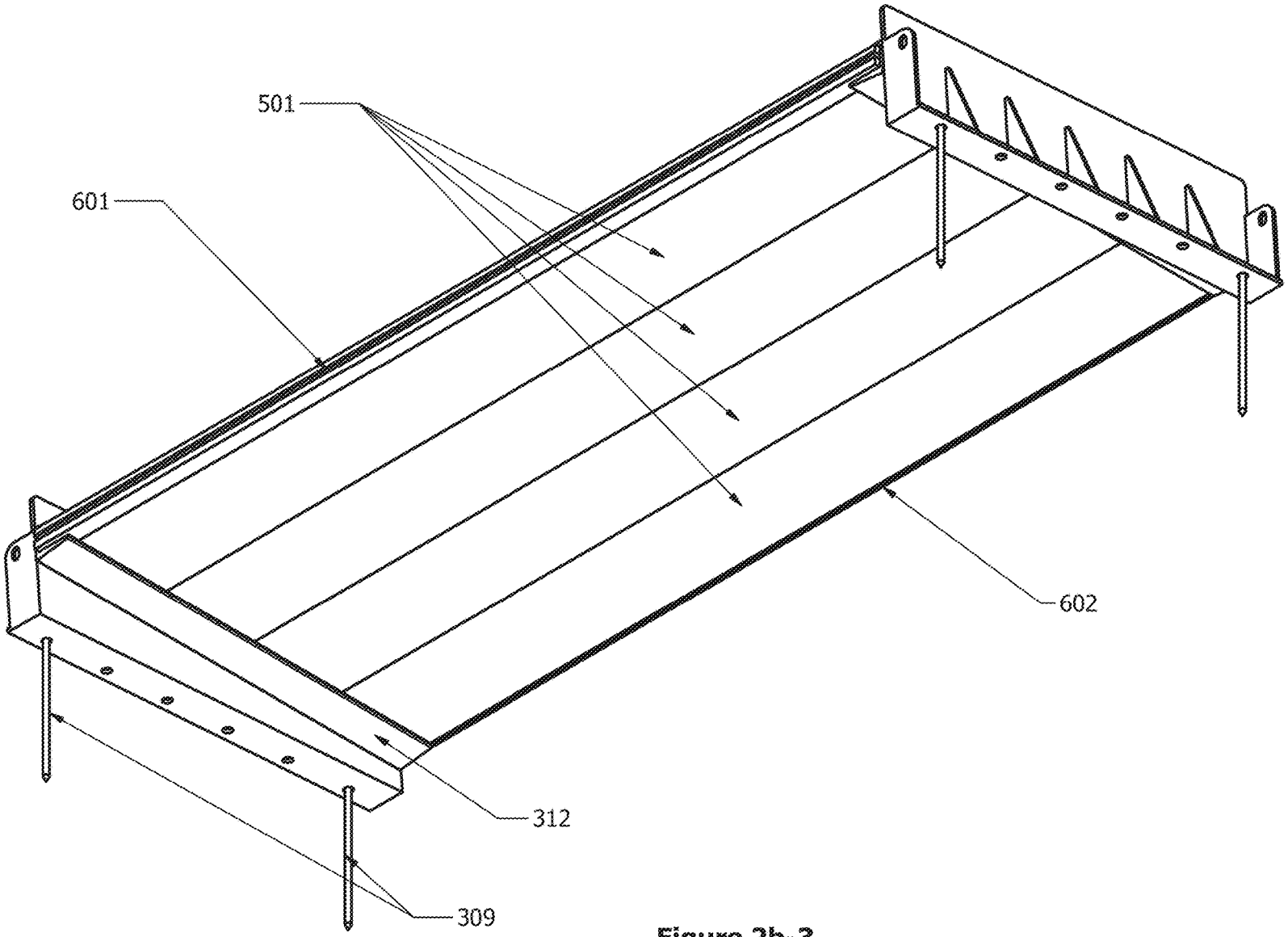

FIG. 2*b*-1 illustrates a perspective view of the on-Ramp transition Segment 200*b*. This segment may be similar to standard segment 300, except the deck support channel 312 is sloped to transition from a standard segment 300 to the on-ramp terminus segment 200*a*.

FIG. 2*b*-2 illustrates a perspective view of the off-ramp transition segment 201*b*. This segment may be similar to on-ramp transition segment 200*b*, except the deck support channel 312 is sloped in the reverse direction as on-ramp transition segment 200*b* to transition from a standard segment 300 to the off-ramp terminus segment 201*a*.

FIG. 2*b*-3 illustrates a perspective view of the underside and opposing end of an example on-ramp transition segment of FIG. 2*b*-1.

Figure 3A:
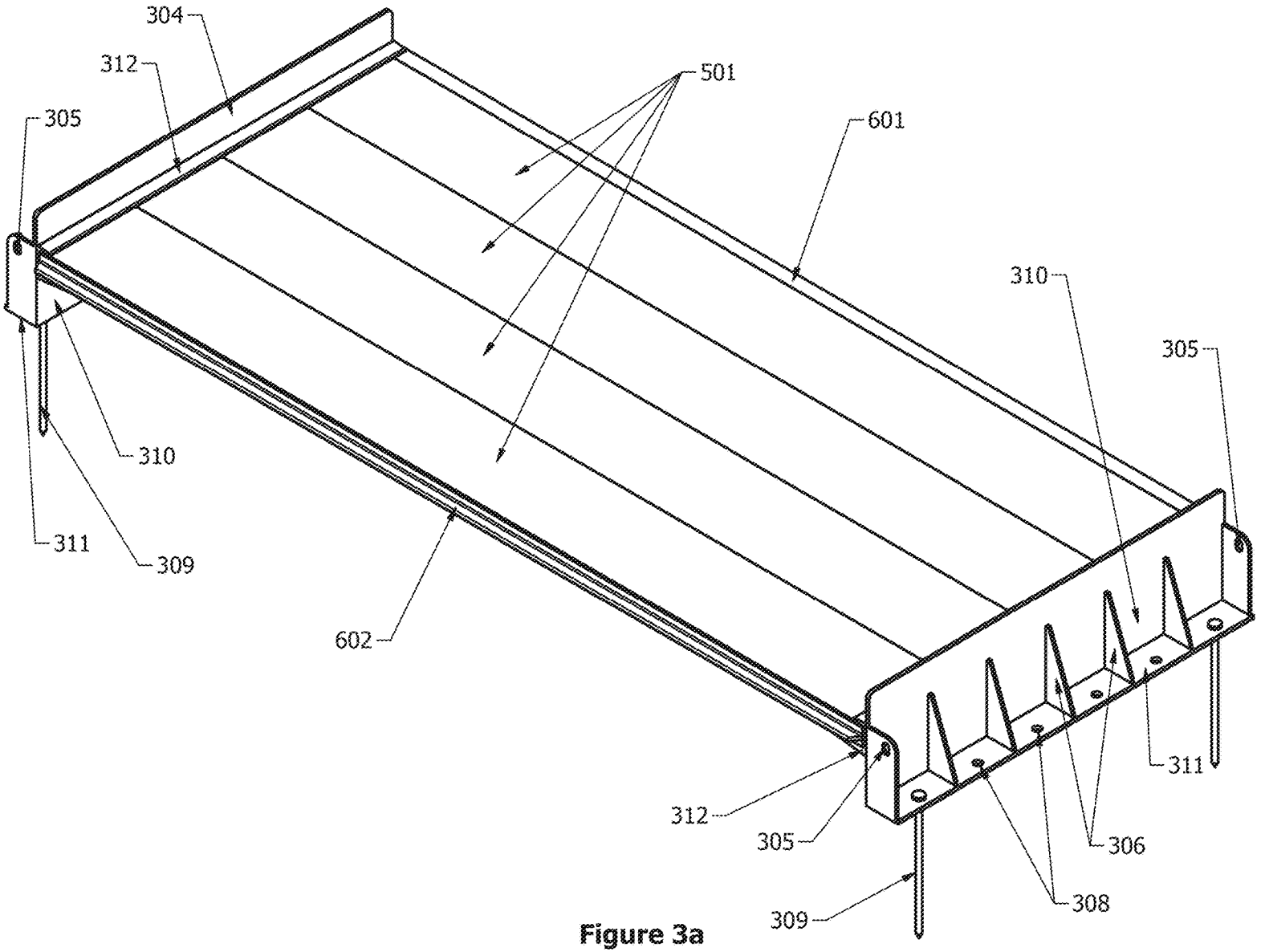
FIG. 3*a* illustrates a perspective view of an example standard segment.

FIG. 3*a* illustrates a perspective view of a standard segment 300. The slip resistant surface details are not shown in this figure for clarity. An example treatment to achieve slip resistance may be seen in FIGS. 5*a*, 5*b*, and 5*c* describing the deck sections. The male rounded finger joint (MRFJ) 602 accommodates connection to adjacent segments while transferring vertical load across the joint and allowing vertical deflections between segments to accommodate changes in vertical geometry of the pathway. The female rounded finger joint (FRFJ) 601 accommodates connection to adjacent segments while transferring vertical load across the joint and allowing vertical deflections and minor horizontal deflections between segments to accommodate changes in vertical and horizontal geometry of the pathway. The combination of MRFJ 602 and FRFJ 601 illustrates one implementation of joint 600 as shown in FIGS. 1*b* through 1*e*. A curb 304 is located on each side of the path to accommodate ADA standards, provide detectable edges, and prevent users in wheelchairs or other devices from departing the pathway. Each curb 304 contains connection flange 305 to accommodate various connection methods and lifting devices if needed. External stiffeners 306 provide for load distribution and stiffen the vertical wall supports 310 and bottom flanges 311 of the structure. The curb 304 and vertical wall supports 310 may comprise the same member as shown in this example. Anchor holes 308 are spaced along the bottom flange 311 to provide for anchors 309 at needed intervals. Multiple anchor holes 308 are provided to allow variations in placement of anchors 309 to avoid items conflicting with anchorage such as utility pull boxes.

Figure 4:
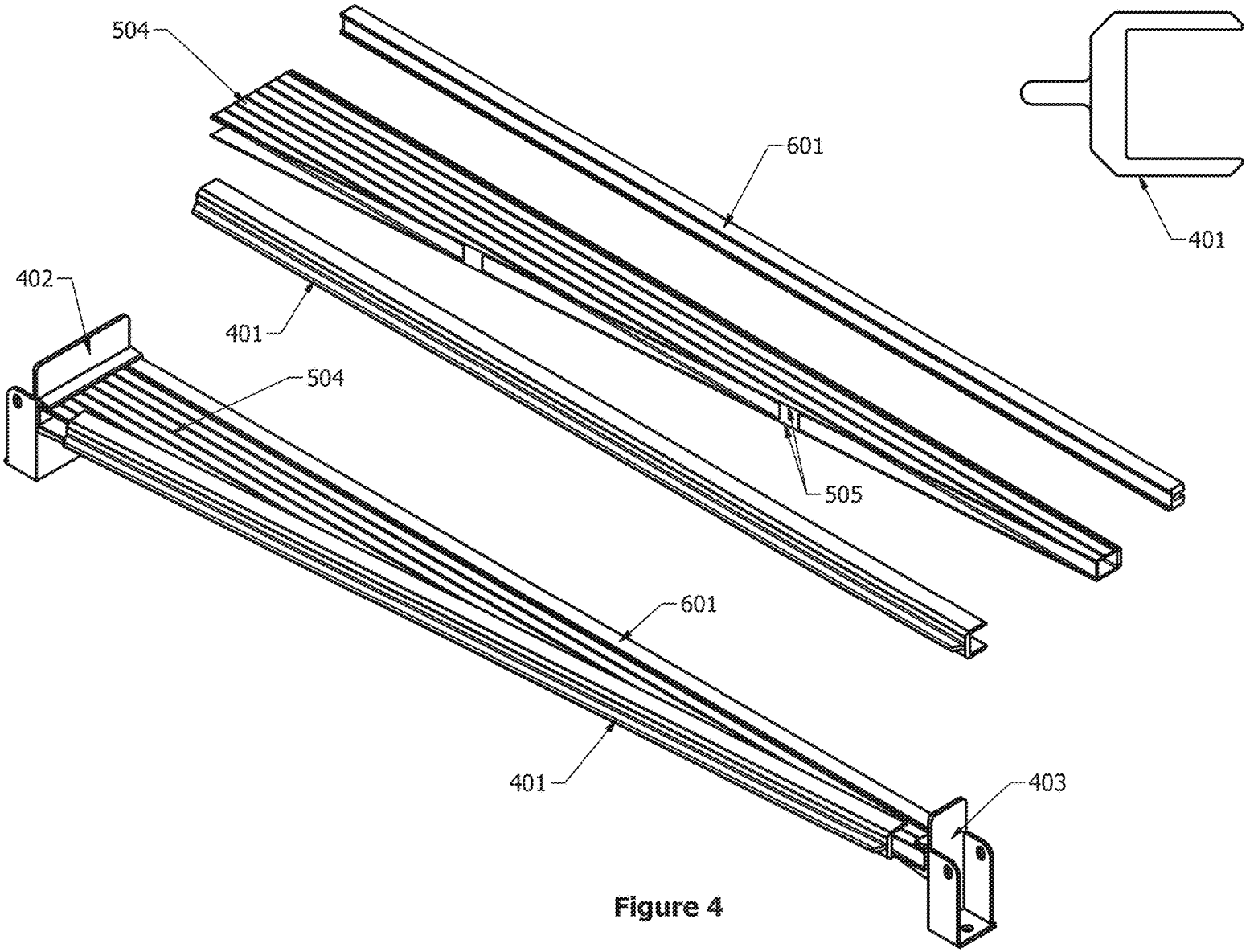
FIG. 4 illustrates a perspective view of an example radial segment allowing for path to follow significant non-linear horizontal geometry.

In addition to standard segments, there may also be t-segments or x-segments to accommodate intersecting pathways. Whereas the straight standard segment of FIG. 3*a* consists of two connecting faces, a t-segment could have three connecting faces and an x-segment could have four connecting faces comprised of FRFJ 501, MRFJ 502, and male deck joiner 401 as shown in FIG. 4.

Figure 3B:
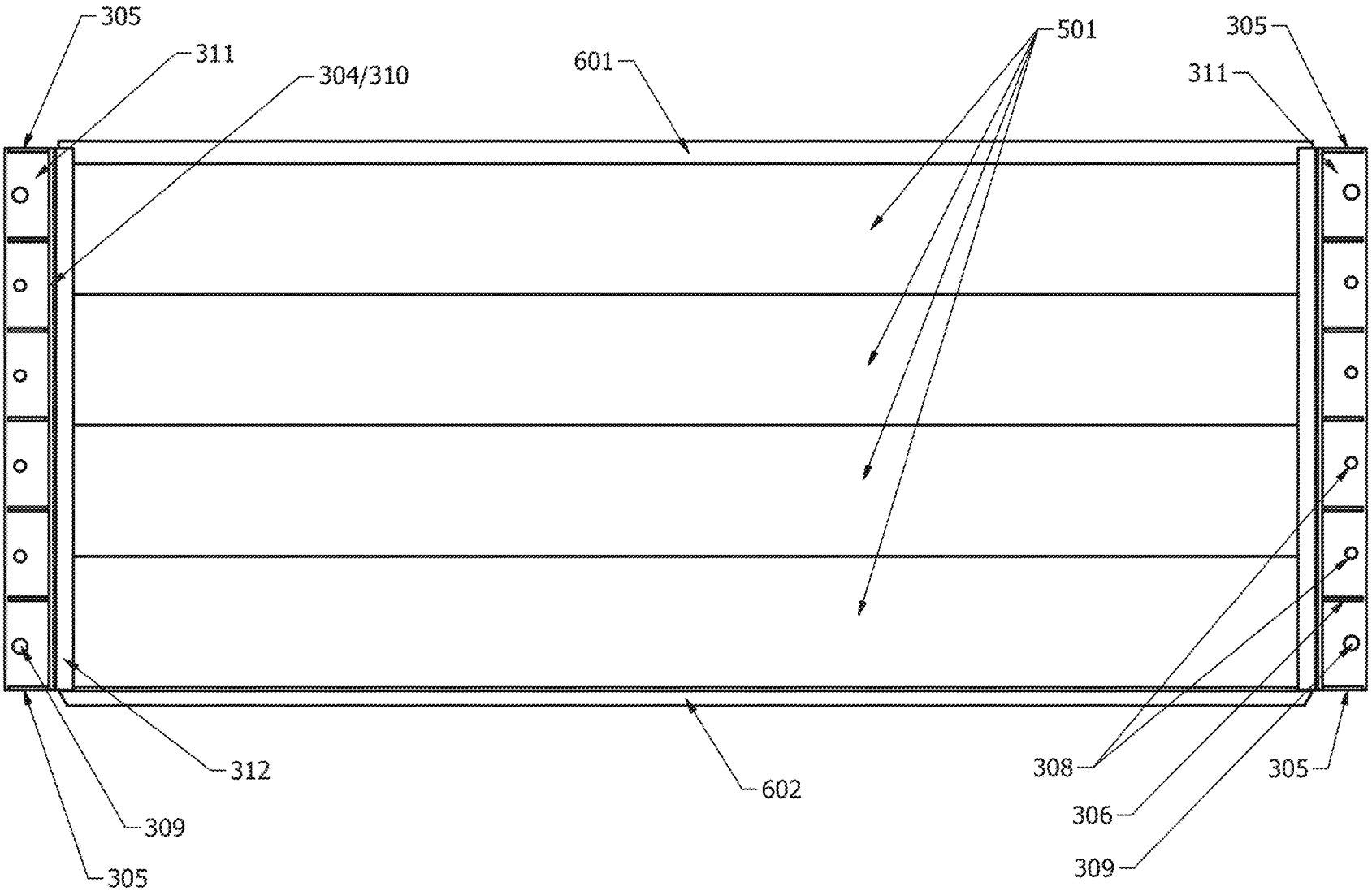
FIG. 3*b* illustrates a plan view of the example standard segment of FIG. 3*a*.

FIG. 3*b* illustrates a plan view of a standard segment 300.

Figure 3C:
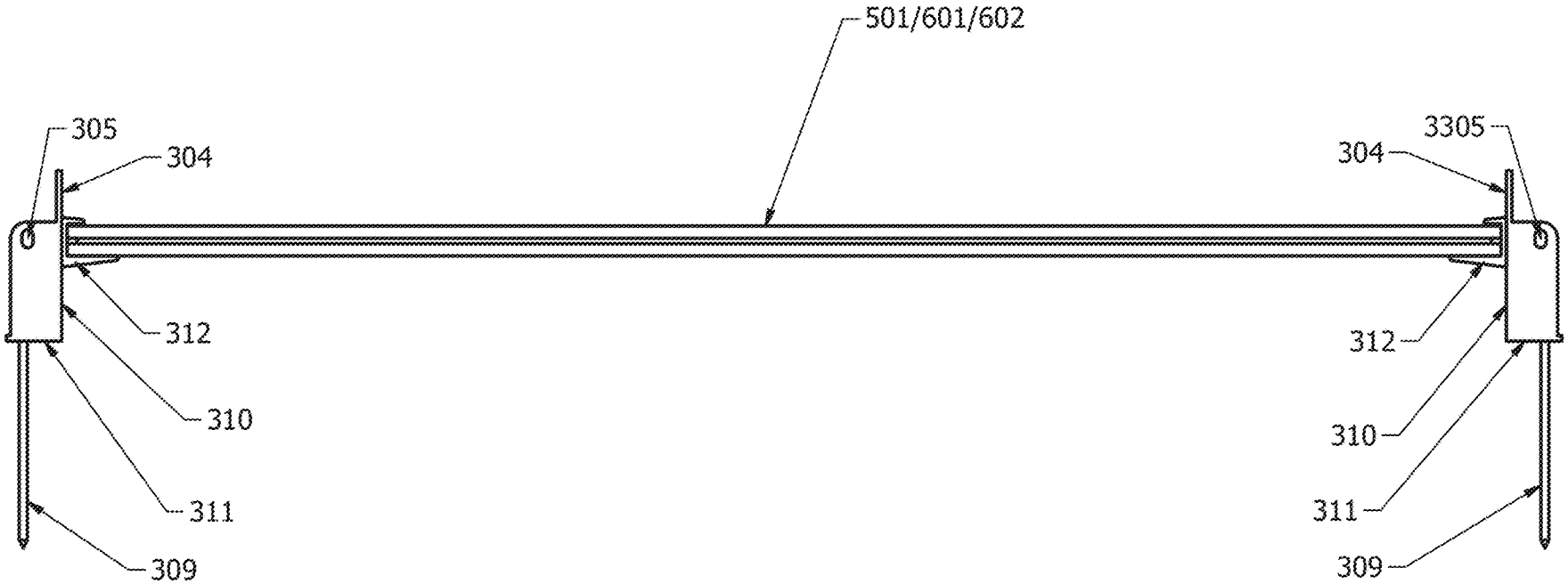
FIG. 3*c* illustrates a cross sectional view of the example standard segment of FIG. 3*a*.

FIG. 3*c* illustrates a cross sectional view of a standard segment 300. This view illustrates a degree of grade separation between the ground and the deck. The bottom flanges 311 may bare on paved surfaces, ground surfaces, beams, or dunnage.

Figure 3D:
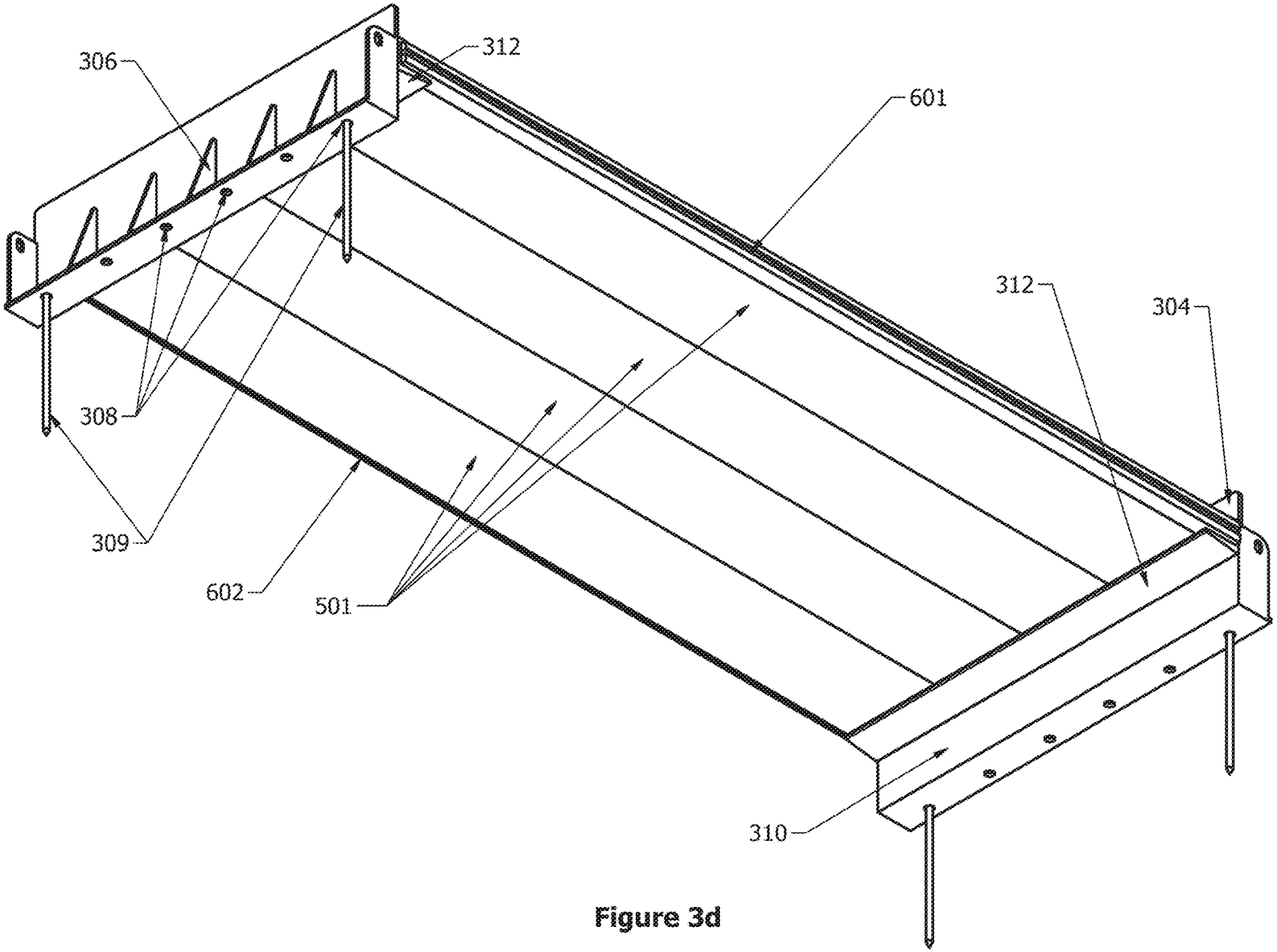
FIG. 3*d* illustrates a perspective view of the underside and opposing end of the example standard segment of FIG. 3*a*.

FIG. 3*d* illustrates a perspective view of the underside of a standard segment 300.

FIG. 4 illustrates a perspective view of an example radial segment 400. These segments may be fixed at certain radial angles to accommodate common changes in horizontal geometry conditions. Radial angles and shapes may vary as required to obtain desired horizontal geometry of the pathway. The FRFJ 601 accommodates connection to adjacent segments while transferring vertical load across the joint and allowing vertical deflections and slight horizontal deflections between segments to accommodate changes in vertical and horizontal geometry of the pathway. The male deck joiner 401 may connect to a mitered deck section 504. Mitered deck section 504 may comprise standard deck section 501, as described in FIG. 5*a* below, that has been cut along the cutting plane 505 to a specific angle to achieve the desired radial angle. The male deck joiner 401 accommodates connection to adjacent segments while transferring vertical load across the joint and allowing vertical deflections between segments to accommodate changes in vertical geometry of the pathway. Radial segment curbs 402 and 403 and associated components may be configured similar to the standard segment 300. For example, radial segment curbs may use the same connection flange 305, external stiffeners 306, vertical wall supports 310, bottom flanges 311, anchor holes 308, and anchors 309 as standard segment 300.

Figure 5A:
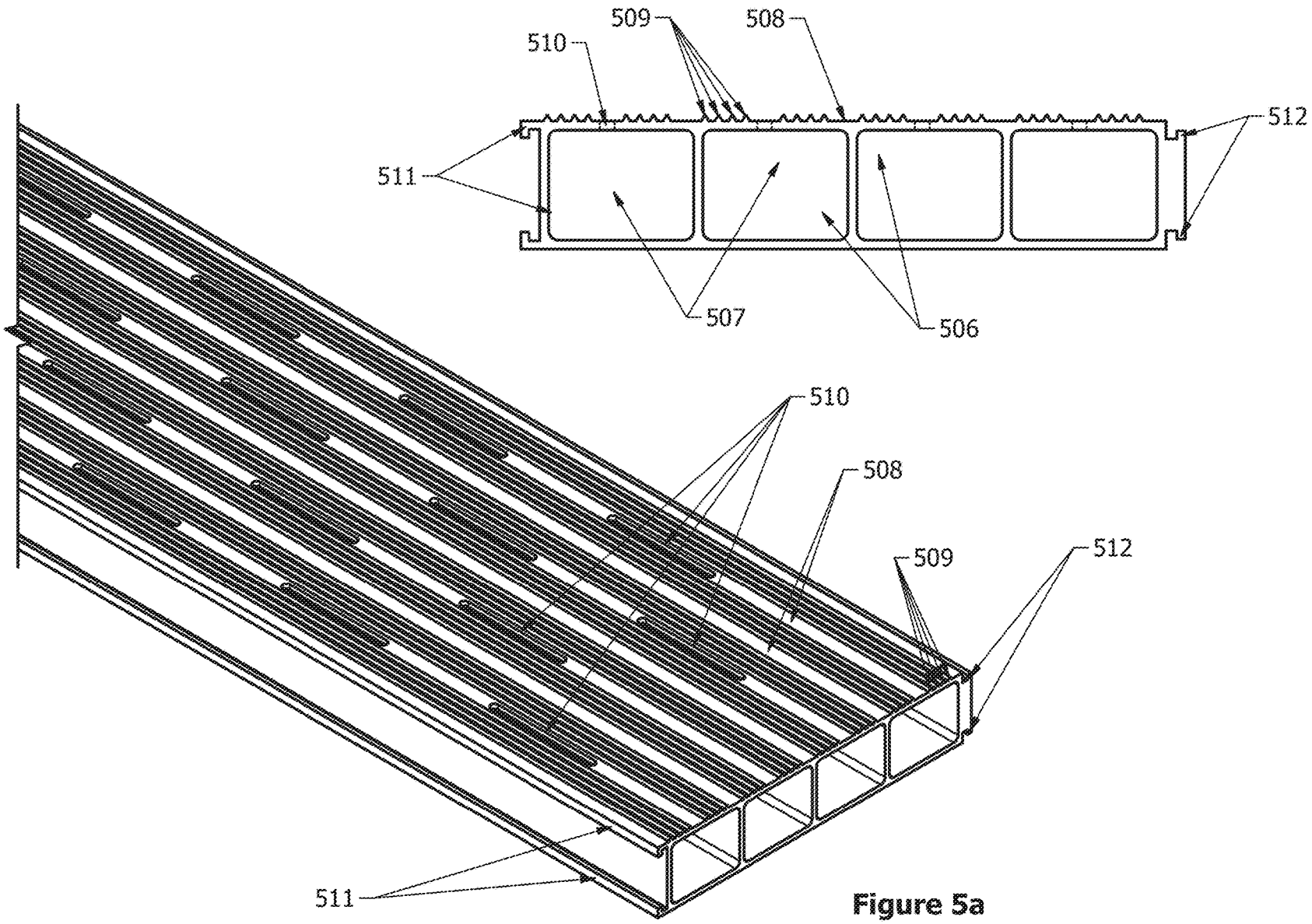
FIG. 5*a* illustrates a perspective view and cross-sectional view of a standard deck section.

FIG. 5*a* illustrates a perspective view and cross-sectional view of an example standard deck section 501. The standard deck section may comprise a thin-walled structural material 506 with deck voids 507. The top of the deck surface 508 may comprise protruding profiles 509 to provide slip resistance in the longitudinal direction of the pathway. Protruding profiles 509 may comprise transverse cuts not exceeding the depth of the protruding profiles to provide slip resistance in the transverse direction of the pathway. The top of the deck surface 508 may comprise openings such as slotted holes 510 to allow for deck drainage. See FIG. 7 for more details of water conveyance. Standard deck section 501 may comprise female deck section joint 511 and male deck section joint 512 to allow interlocking to a series of standard deck section 501, ramp landing deck section 503, FRFJ 601, MRFJ 602, or joint adapter 603.

Figure 5B:
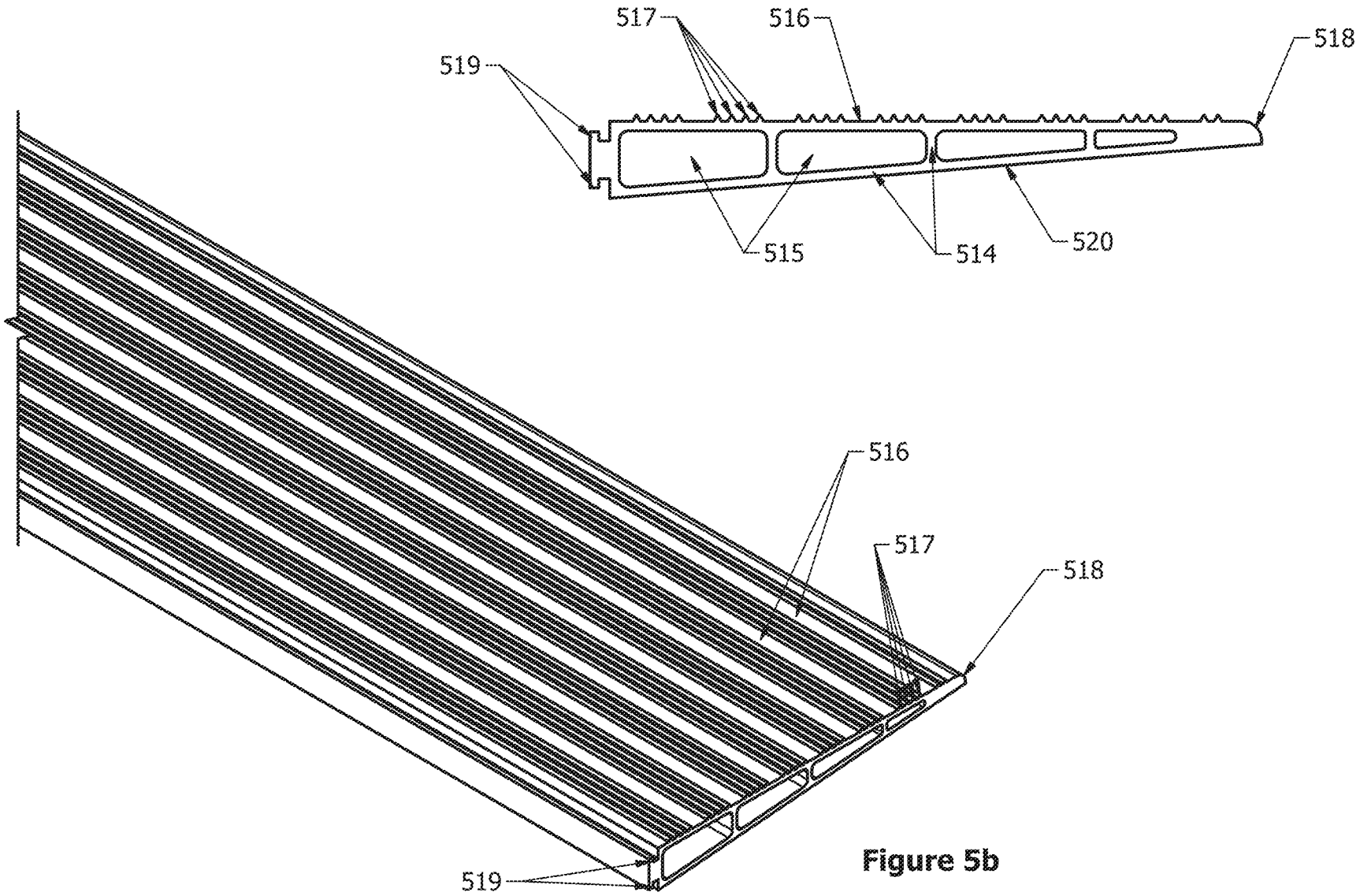
FIG. 5*b* illustrates a perspective view and cross-sectional view of a ramp terminus deck section.

FIG. 5*b* illustrates a perspective view and cross-sectional view of an example ramp terminus deck section 502. The ramp terminus deck section 502 may comprise a thin-walled structural material 514 with deck voids 515. The top of the deck surface 516 may comprise protruding profiles 517 to provide slip resistance in the longitudinal direction of the pathway. Protruding profiles 517 may comprise transverse cuts not exceeding the depth of the protruding profiles to provide slip resistance in the transverse direction of the pathway. Ramp terminus deck section 502 may comprise a radial or chamfered terminus 518 to allow transition to the at-grade pavement surface and male deck section joint 519 to allow interlocking to a ramp landing deck section 503. The bottom of deck surface 520 of the ramp terminus deck section 502 may bear on at-grade or pavement surface and be non-parallel to the top of deck surface 516.

Figure 5C:
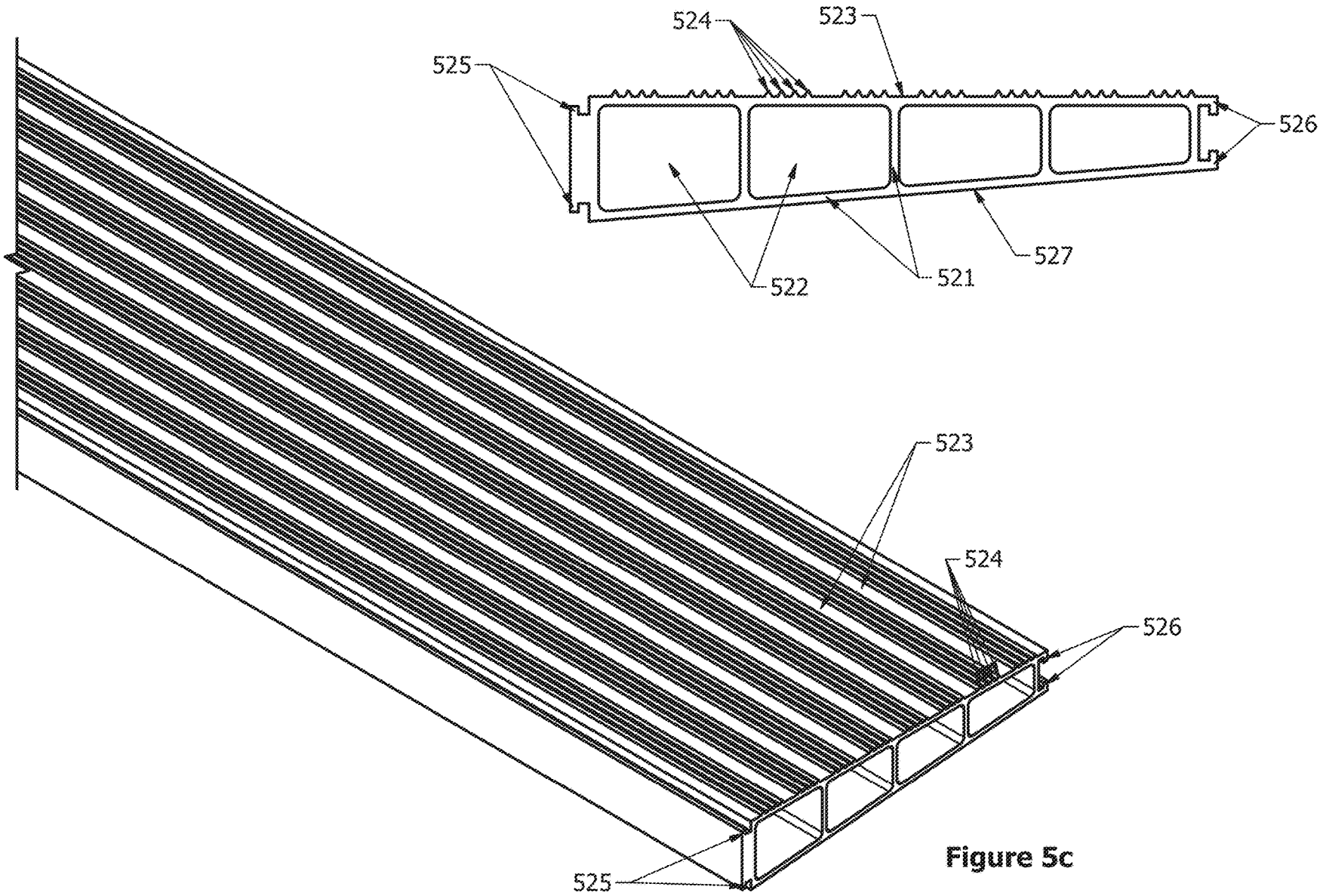
FIG. 5*c* illustrates a perspective view and cross-sectional view of a ramp landing deck section.

FIG. 5*c* illustrates a perspective view and cross-sectional view of an example ramp landing deck section 503. The ramp landing deck section 503 may comprise a thin-walled structural material 521 with deck voids 522. The top of the deck surface 523 may comprise protruding profiles 524 to provide slip resistance in the longitudinal direction of the pathway. Protruding profiles 524 may comprise transverse cuts not exceeding the depth of the protruding profiles to provide slip resistance in the transverse direction of the pathway. Ramp landing deck section 503 may comprise male deck section joint 525 to allow interlocking to a standard deck section 501, FRFJ 601, MRFJ 602, or joint adapter 603. Ramp landing deck section 503 may comprise female deck section joint 526 to allow interlocking to a ramp terminus deck section 502. The bottom of deck surface 527 of the ramp landing deck section 503 may bear on at-grade or pavement surface and be non-parallel to the top of deck surface 523.

Figure 6A:
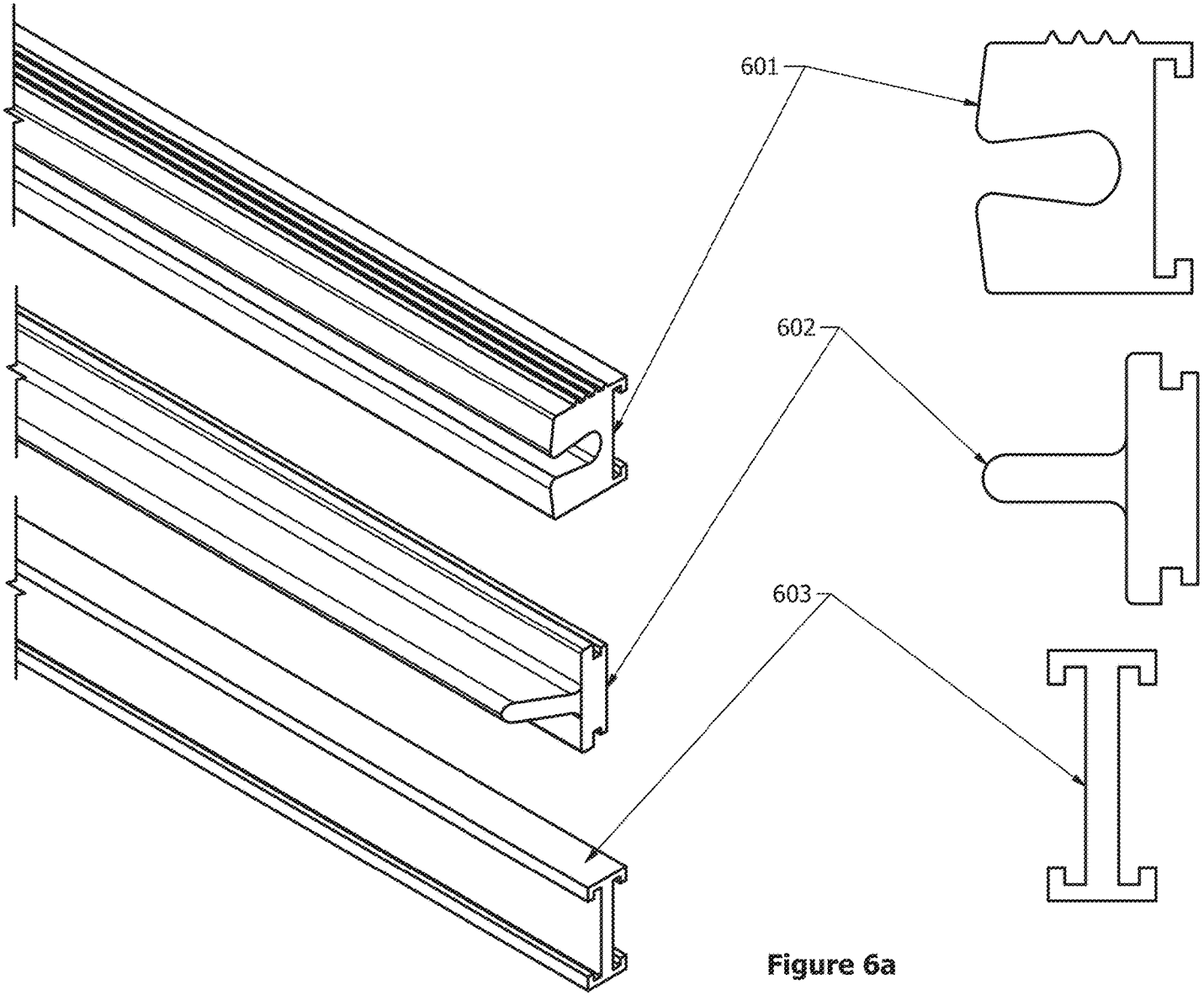
FIG. 6*a* illustrates perspective views and cross-sectional views of a female deck joint, a male deck joint, and a joint adapter.

FIG. 6*a* illustrates perspective views and cross-sectional views of a female rounded finger joint (FRFJ) 601, male rounded finger joint (MRFJ) 602, and joint adapter 603. The combination of MRFJ 602 and FRFJ 601 illustrates one implementation of joint 600. Female rounded finger joint (FRFJ) 601, male rounded finger joint (MRFJ) 602, and joint adapter 603, collectively represent one example implementation for joint 600 described above.

Figures 1, 6B:
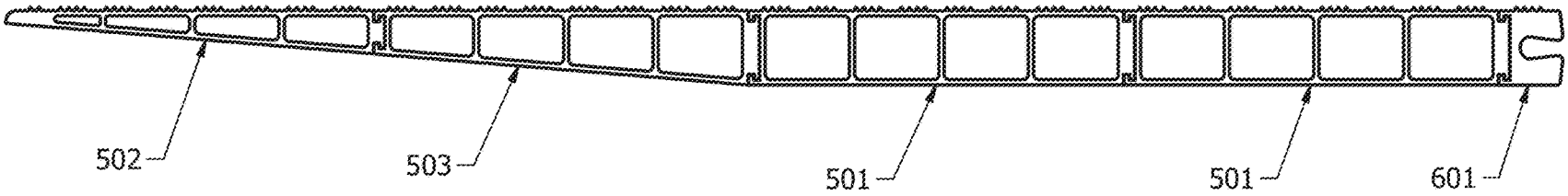
Figures 2, 6B:
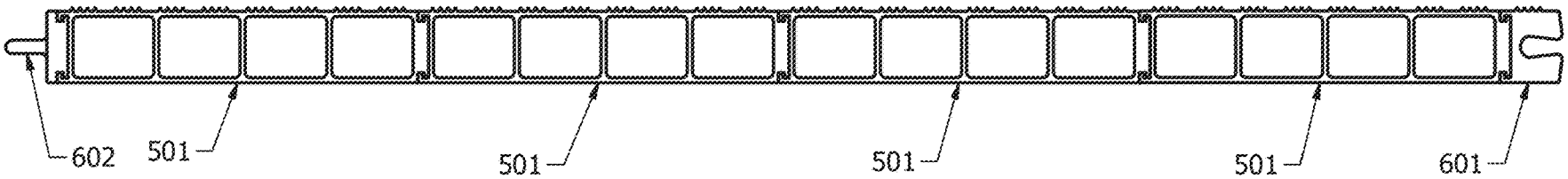
Figures 3, 6B:
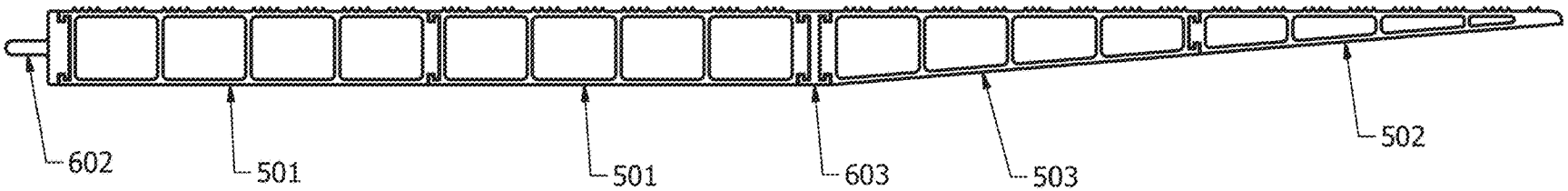

FIGS. 6*b*-1 through 6*b*-3 illustrate example configurations of the various parts used to create the deck of each segment type. The configuration illustrated in FIG. 6*b*-1 comprises ramp deck terminus section 502, ramp deck landing section 503, multiple standard deck sections 501, and FRFJ 601 which may be used for the deck of example on-ramp terminus segment 200*a*. The configuration illustrated in FIG. 6*b*-2 comprises MRFJ 602, multiple standard deck sections 501, and FRFJ 601 which may be used for the deck of example standard segment 300, example on-ramp transition segment 200*b*, or example off-ramp transition segment

201*b*. The configuration illustrated in FIG. 6*b*-3 comprises ramp deck terminus section 502, ramp deck landing section 503, joint adapter 603, multiple standard deck sections 501, and MRFJ 602 which may be used for the deck of off-ramp terminus segment 201*a*.

Figures 1, 6C:
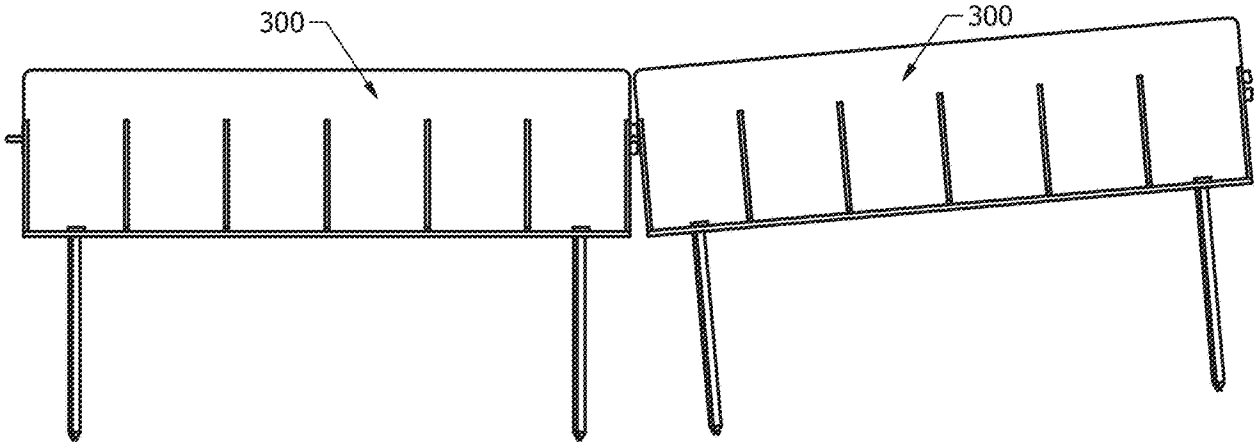
Figures 2, 6C:
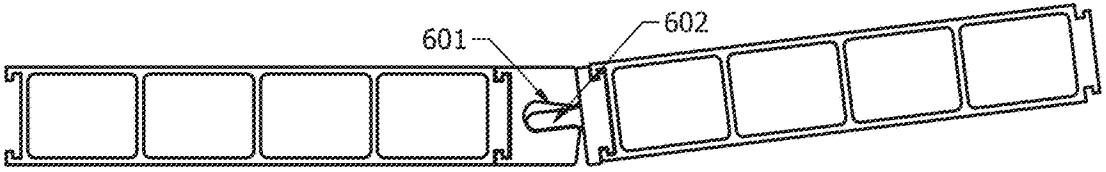
Figures 3, 6C:
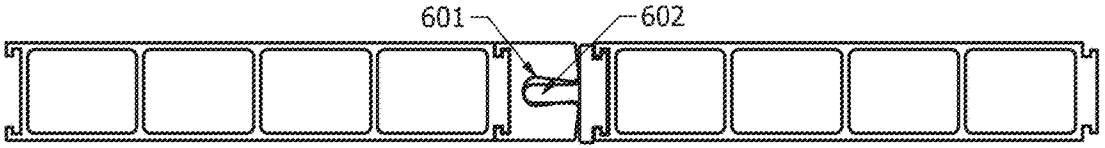
Figures 4, 6C:
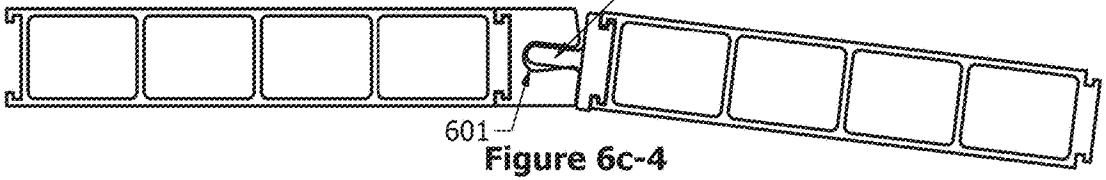

FIGS. 6*c*-1 through 6*c*-4 illustrate examples of vertical deflection between segments which may be accommodated by the FRFJ 601 and MRFJ 602. FIG. 6*c*-1 shows an elevation of two example standard segments 300 following the vertical profile geometry of a pathway. FIGS. 6*c*-2, 6*c*-3, and 6*c*-4 show examples of how the FRFJ 601 and MRFJ 602 fit together to allow the range of deflection in both the positive and negative directions of deflection.

Figure 6D:
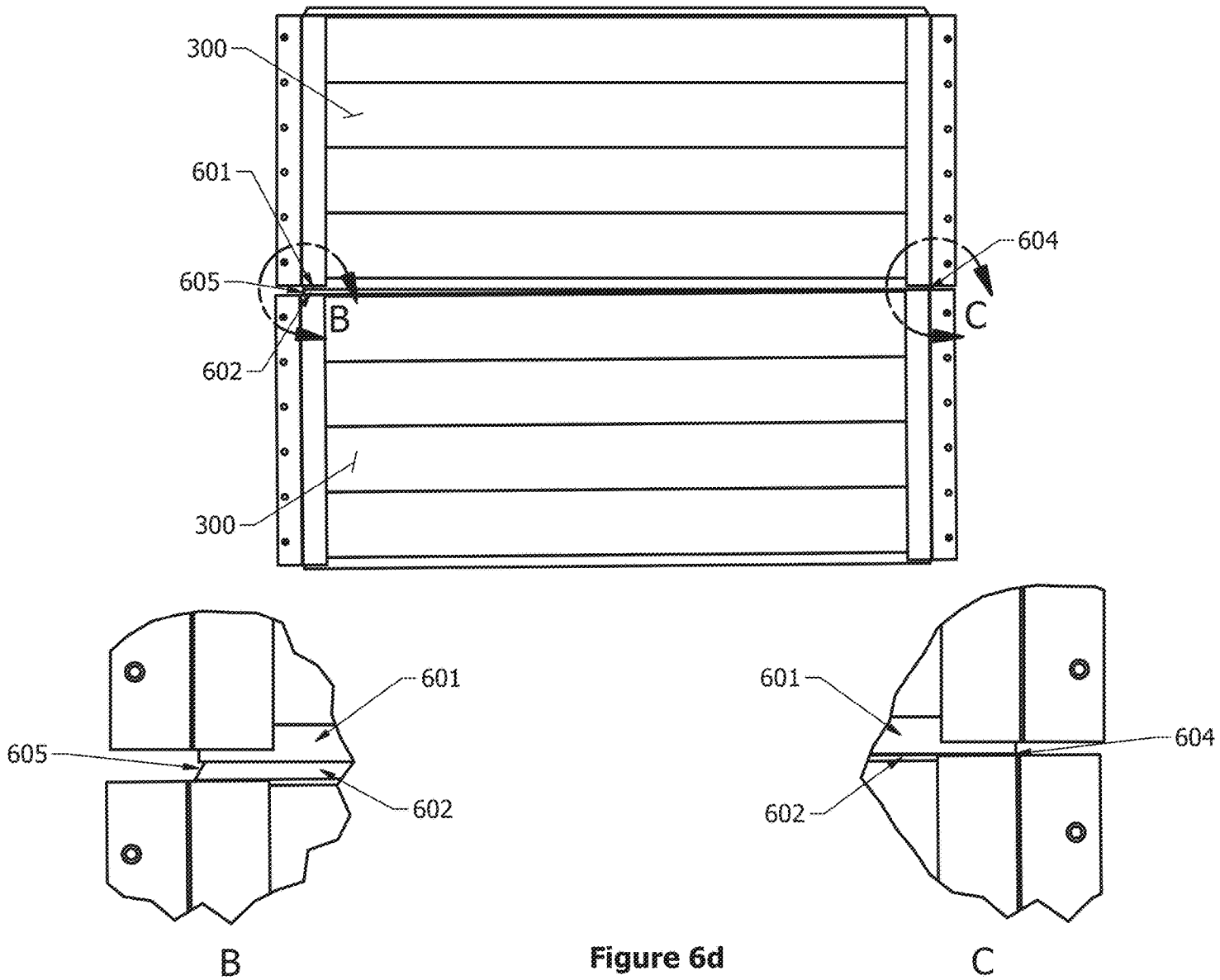
FIG. 6*d* illustrates an example range of motion of an example rounded finger joint to accommodate slight horizontal deflections between segments.

FIG. 6*d* illustrates an example slight horizontal deflection between segments which may be accommodated by the interaction between FRFJ 601 and MRFJ 602. The underside of two example standard segments 300 are shown following a slight horizontal profile geometry of a pathway. The interaction between FRFJ 601 and MRFJ 602 allows side B 604 of the joint to be fully engaged with little to no gap, whereas side A 604 of the joint may be separated a distance to produce a chorded slight horizontal curve to the pathway simultaneously with any vertical deflection of the pathway. These deflections may be accommodated while maintaining restriction of relative vertical movement between segments.

Figure 7:
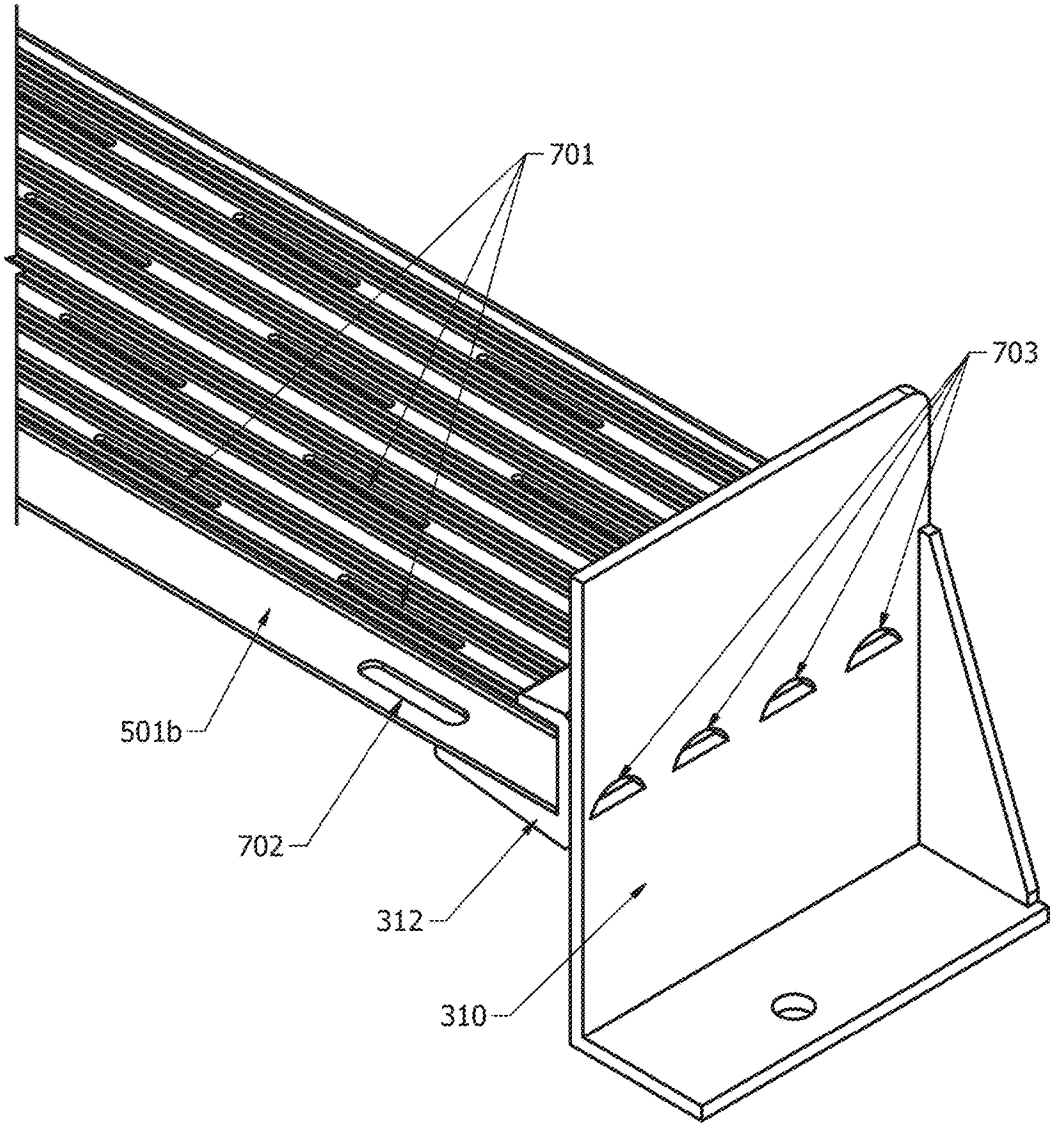
FIG. 7 illustrates an example of a deck drainage system showing example deck Drainage slots and example weepholes.

FIG. 7 illustrates an example of a deck drainage system showing deck voids 501*b* acting as deck drainage chambers in standard deck section 501. A perspective view of a standard segment 300 is shown cut transversely to the pathway to expose the otherwise hidden deck drainage chamber. A standard deck section 501 may comprise deck drainage slots 701 allowing water to drain into the deck voids 501*b*. deck voids 501*b* may comprise weepholes 702 to allow water to exit the deck voids 501*b* at each end of standard deck section 501 just prior to deck support channel 312, or weepholes 703 may be included in deck support channel 312 and vertical wall supports 310 to allow water to exit to the outer side of the system keeping the underside of the pathway dry. Water may flowthrough deck drainage slots 701 into the deck voids 501*b*, then through the deck voids 501*b* toward the weepholes 702 or 703 on either side of the pathway.

Figure 8:
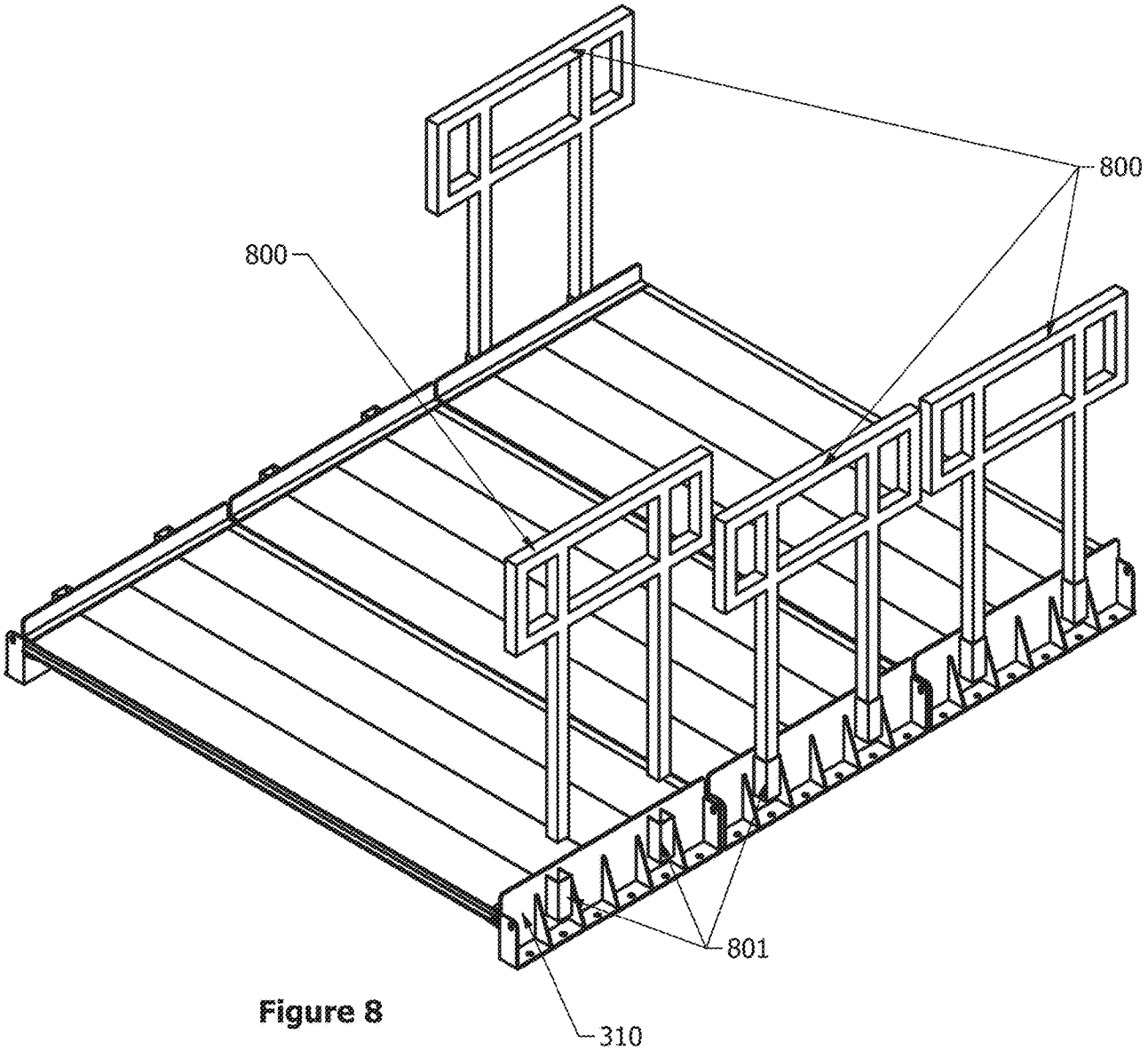
FIG. 8 illustrates an assembled guiderail system.

FIG. 8 illustrates an example of a modular guiderail 800 system. In this example, standard segments 300 is used to show one implementation of the guiderail 800 system. The vertical wall supports 310 of standard segments 300 may contain guiderail supports 801 to receive vertical legs of guiderail 800. These guiderail 800 sections may be placed as needed.

Figure 9A:
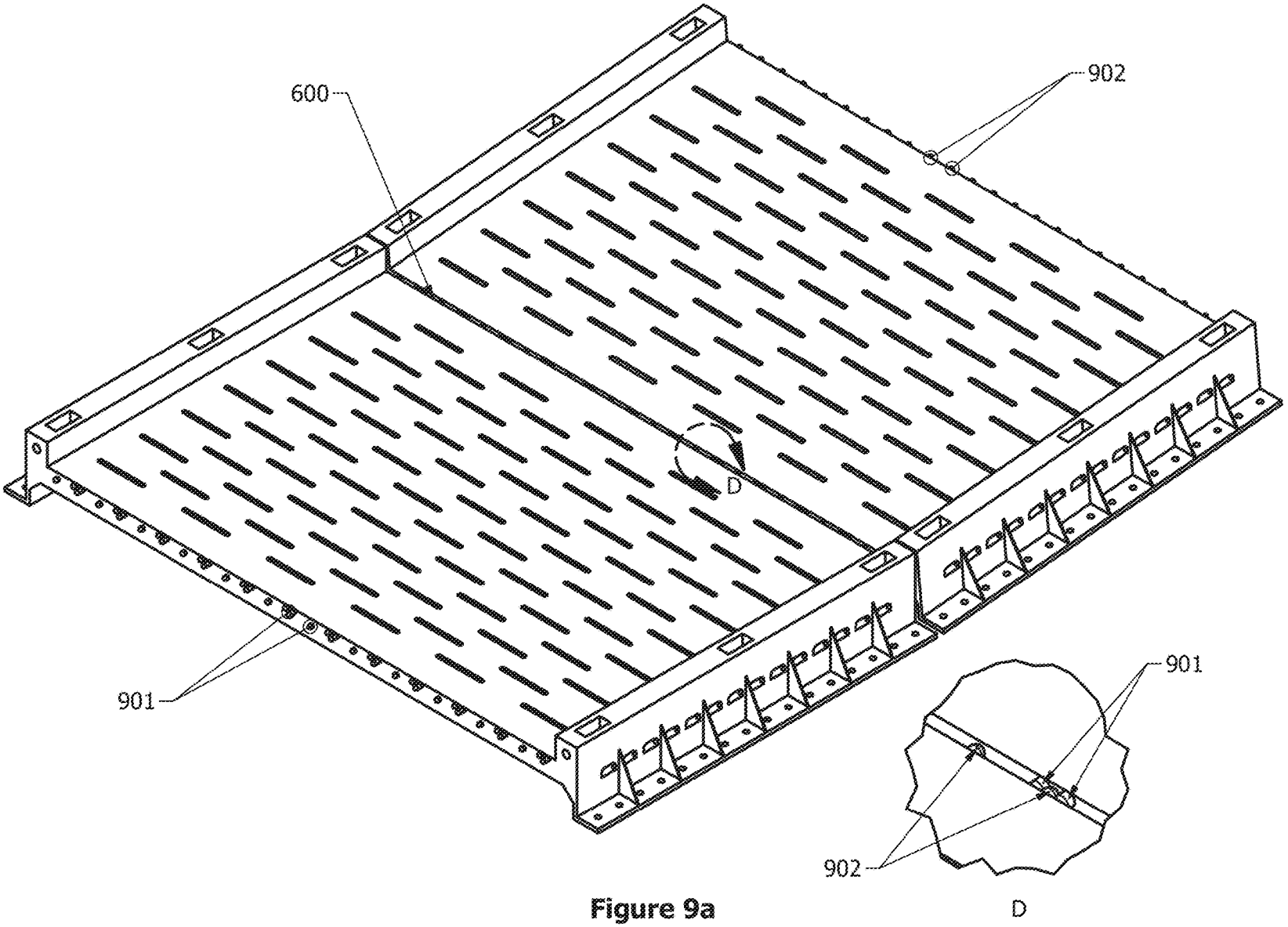
FIGS. 9*a* through 9*c* illustrate an example of a Rounded Alternating Finger Joint.
Figure 9B:
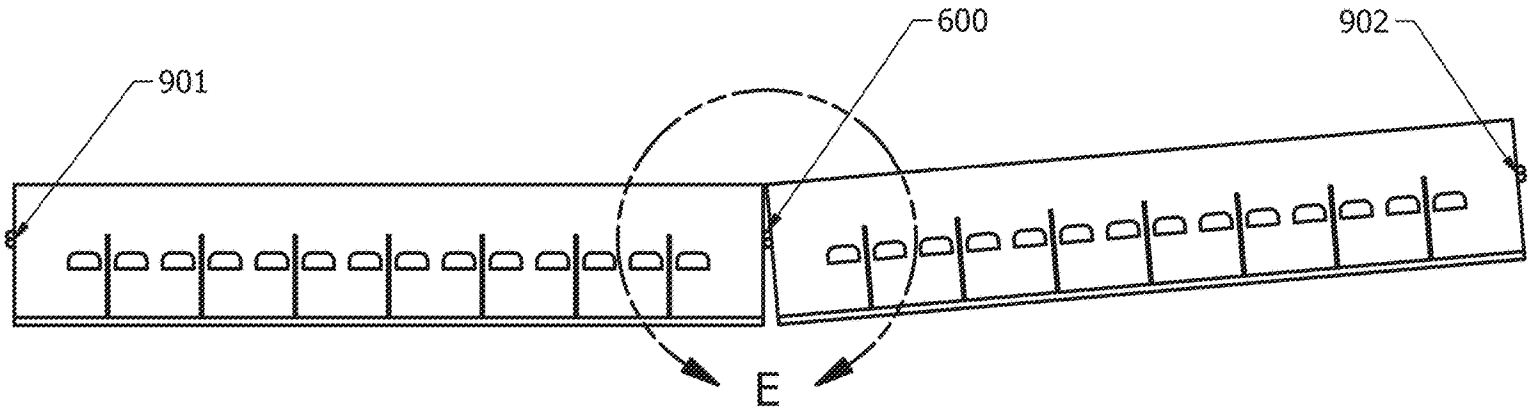
Figure 9B:
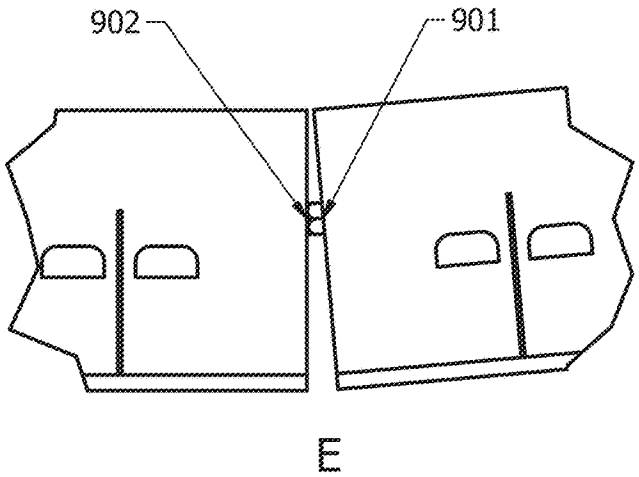
Figure 9C:
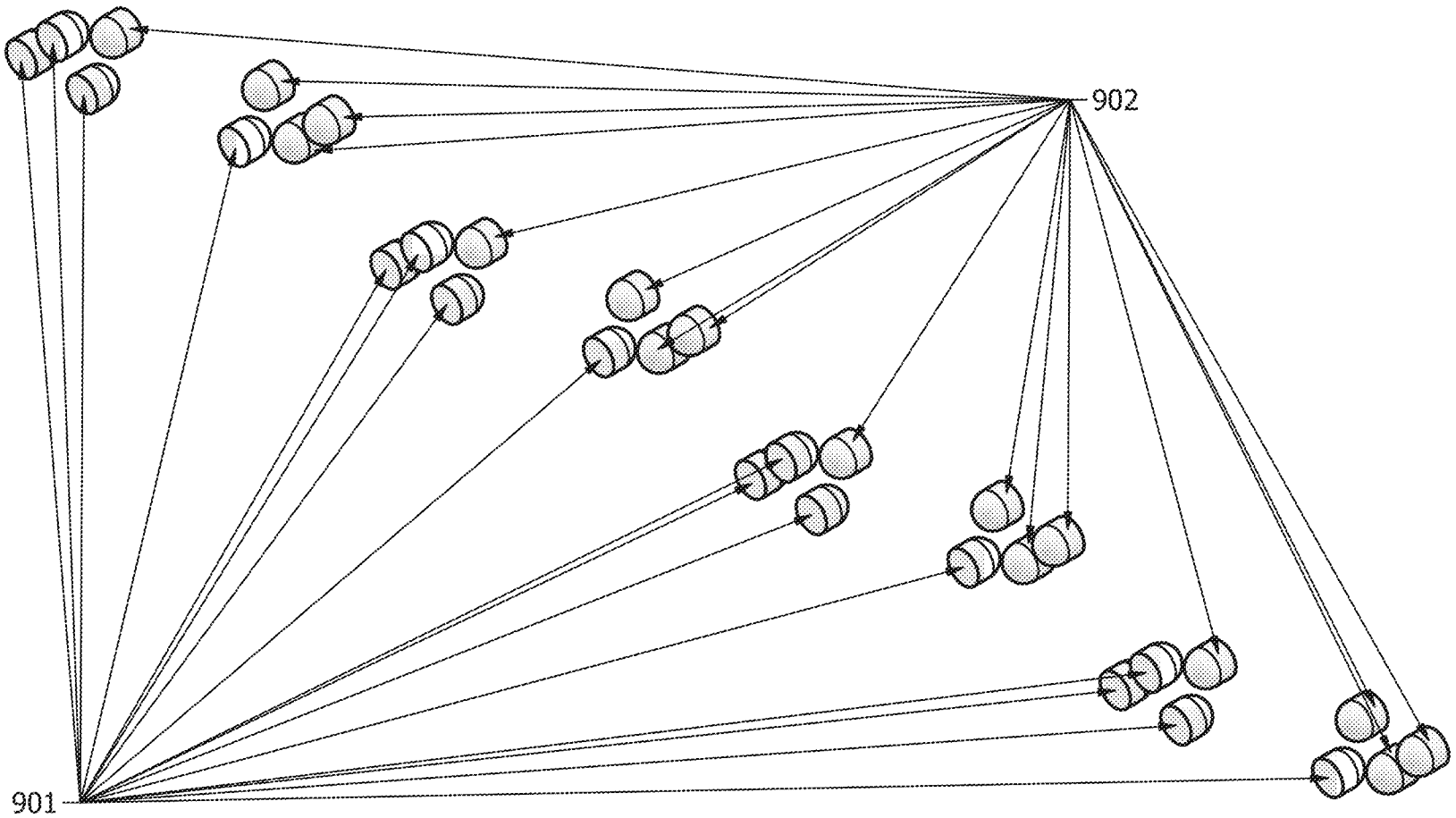

FIGS. 9*a* through 9*c* illustrate a rounded alternating finger joint. The rounded alternating finger joint is comprised of a mating of the forward rounded alternating finger joint (FRAFJ) 901 and the back rounded alternating finger joint (BRAFJ) 902. Size, spacing, quantity, orientation, and shape of FRAFJ 901 components and BRAFJ 902 components may vary. Variations may be required based on the materials used, manufacturing processes, loading conditions, joint openings, and range of movement required in any direction. The mating of the FRAFJ 901 and the BRAFJ 902 allows for segments to follow non-linear vertical geometry of the pathway while maintaining contact to transfer load across segments and to maintain relative vertical and horizontal alignment with adjacent segments. Rounded finger shapes may be modified to allow for segments to follow slight non-linear horizontal geometry. FIG. 9*a* illustrates a perspective view of two standard segment 300 units with a change in vertical alignment at the joint 600. FIG. 9*b* illustrates an elevation view of that shown in FIG. 9*a*. Detail E shows a magnified view of the joint 600. Each segment may comprise one FRAFJ 901 and one BRAFJ 902 on opposing ends in the direction of the pathway. FIG. 9*c* illustrates two adjacent isolated FRAFJ 901 and BRAFJ 902 components. Three rounded fingers of FRAFJ 901 are mated with one rounded finger of BRAFJ 902. One rounded finger of FRAFJ 901 is mated with three rounded fingers of BRAFJ 902. The pattern for the rounded fingers alternates in this manner along the connecting face of each adjacent segment to form the rounded alternating finger joint. FRAFJ 901 and BRAFJ 902 collectively represent one example implementation for joint 600 described above.

In accordance with the techniques described above, a modular system for constructing an elevated pathway may, for example, include a first pathway segment and a second pathway segment. The modular system may also include additional pathway segments as described above. The first and second pathway segments may, for example, be any of on-ramp terminus segment 200*a*, on-ramp transition segment 200*b*, off-ramp transition segment 201*b*, standard segment 300, or radial segment 400. Either or both of the first pathway segment and the second pathway segment may include an elevated platform portion. A top side of the elevated platform portion, such as the top side of standard deck section 501, ramp terminus deck section 502, or ramp transition deck section 503, may be configured for pedestrian or light vehicle traffic. The top sides of the pathway segments may be sufficiently aligned to form a contiguous pathway.

The first and second pathway segments may additionally include edge supports configured to bare a load of the elevated platform portions and to contact a ground surface to create a grade separation between the ground surface and a bottom side of the first elevated platform portion. The edge supports may include apertures, such as vents or openings, configured to permit air flow between the ground surface and the bottom side of the elevated platform portions. The edge supports may be configured to straddle a structure, such as a sidewalk, an in-ground utility box, a hole, or any other such structure, such that the bottom side of the elevated platform portion does not contact the structure.

The first and second pathway segments may also each include joints, such as FRFJ 601 and MRFJ 602 configured to attach to one another in order to limit a motion of the second pathway segment relative to the first pathway segment. The joints may also, for example, transfer a portion of the load of the second elevated platform portion to the first pathway segment, or vice versa. The joints may be configured to allow the second elevated platform to be positioned relative to the first pathway segment, and the articulation of the joints may enable the pathway segments to create a pathway that approximately follows the desired horizontal geometry of the pathway and vertical profile grade of the ground.

The joint may, for example, include male and female rounded finger joints configured to limit relative movement between segments while allowing the segments to follow the horizontal geometry and vertical profile grade of the ground. A joint of the first pathway segment may, for example, mate with a joint of the second pathway segment.

In some examples, the edge supports may include flanges with anchor holes configured to receive anchors. Ground anchors may limit separation between pathway segments and provide for edge supports.

Each pathway segment may also include locking structures to secure the pathway segments to one another. Each locking structure may include connection Flange 312 configured to receive a connector, such as coil bolt 104 and coil nut 105. The connector may create a compression force between the pathway segments and limit separation between the pathway segments. The locking structures may not be needed for all use cases. For example, in some use cases, anchors, such as anchors 309, may sufficiently limit that movement of the pathway segments, such that additional locking is unnecessary. In some use cases, however, such as when ground anchors cannot be used, or when the soil is soft and does not provide enough rigidity, the additional locking structures may provide the system with additional stability. The connector may be fully or partially threaded along the length and include a termination piece. The termination piece may, for example, be a threaded nut to secure the connection.

The pathway segments may include openings on a top side of the elevated platforms to allow water into one or more chambers that can carry the water to one or more drainage holes. If the pathway segments are covering a sidewalk, for example, the chamber and drainage holes (e.g., weepholes) may direct the water toward the outside edge supports, and thus not on top of the sidewalk.

The one or more chambers may be located under the top side of the elevated platforms, and the drainage holes (e.g., weep holes) may be configured to release the water to an outer side near the edge supports.

In some instances, a guiderail may be connected to, e.g., secured to, the elevated platforms.

The pathway segments may be constructed from a variety of materials including, but not limited to, polymeric materials, glass fiber reinforced polymers, carbon fiber reinforced polymers, basalt fiber reinforced polymers, ferrous metal materials, and aluminum materials.

The following numbered clauses illustrate one or more aspects of the devices and techniques described in this disclosure.

Clause 1: A modular system for constructing an elevated pathway, the system comprising: a first pathway segment comprising: a first elevated platform portion; first edge supports configured to bare a load of the first elevated platform portion, wherein the first edge supports are configured to contact a ground surface and to create a grade separation between the ground surface and a bottom side of the first elevated platform portion; a first joint; and a second pathway segment comprising: a second elevated platform portion; second edge supports configured to bare a load of the second elevated platform portion, wherein the second edge supports are configured to contact the ground surface and to create a grade separation between the ground surface and a bottom side of the second elevated platform portion; a second joint configured to attach to the first joint to limit a motion of the second pathway segment relative to the first pathway segment.

Clause 2: The system of clause 1, wherein the first edge supports include first apertures configured to permit air flow between the ground surface and the bottom side of the first elevated platform portion.

Clause 3: The system of clause 1, wherein the second edge supports are configured to straddle a structure under the bottom side of the second elevated platform portion without contacting the structure.

Clause 4: The system of clause 1, wherein the second joint is configured to transfer a portion of the load of the second elevated platform portion to the first pathway segment.

Clause 5: The system of clause 1, further comprising: a third pathway segment comprising: a third elevated platform portion; third edge supports configured to bare a load of the third elevated platform portion, wherein the third edge supports are configured to contact the ground surface and to create a grade separation between the ground surface and a bottom side of the third elevated platform portion; a third joint configured to attach to the second pathway segment to limit a motion of the third pathway segment relative to the second pathway segment.

Clause 6: The system of clause 5, wherein a top side of the first elevated platform portion, a top side of the second elevated platform portion, and a top side of the third elevated platform portion form a contiguous pathway.

Clause 7: The system of clause 6, wherein a first side of the third elevated platform is longer than a second side of the third elevated platform, such that the third elevated platform causes the contiguous pathway to be non-straight.

Clause 8: The system of clause 7, wherein a first side of the third elevated platform is longer than a second side of the third elevated platform, such that the third elevated platform causes the contiguous pathway to curve.

Clause 9: The system of clause 5, wherein: a top side of the first elevated platform portion slopes towards the ground surface; a top side of the second elevated platform portion is approximately parallel to the ground surface; and a top side of the third elevated platform portion slopes towards the ground the surface.

Clause 10: The system of clause 1, wherein a top side of the first elevated platform portion is angled relative to the ground surface.

Clause 11: The system of clause 1, wherein the second pathway segment further comprises: openings in a top side of the first elevated platform, wherein the openings are configured to allow water into a chamber that carries the water to one or more drainage holes.

Clause 12: The system of clause 11, wherein the chamber is located under the top side of the first elevated platform, and one or more weepholes are configured to release the water to an outer side of the second edge supports.

Clause 13: The system of clause 1, wherein the segment joint drainage channel captures water penetrating the joint and conveys and release the water to an outer side of the pathway.

Clause 14: The system of clauses 1, wherein the first pathway segment comprises a first locking structure and the second pathway segment comprises a second locking structure, wherein the first locking structure is configured to secure the first locking structure to the second locking structure.

Clause 15: The system of clause 14, wherein the first locking structure comprises a first, enclosed hollow channel and the second locking structure comprises a second, enclosed hollow channel, wherein the first, enclosed hollow channel and the second, enclosed hollow channel are configured to receive a flexible connector.

Clause 16: The system of clause 15, wherein the flexible connector creates a compression force between the first pathway segment and the second pathway segment.

Clause 17: The system of clause 15, wherein the flexible connector limits separation between the first pathway segment and the second pathway segment.

Clause 18: The system of any of clauses 15-17, wherein the flexible connector is fully or partially threaded along the length and includes a termination piece.

Clause 19: The system of clause 18, wherein the termination pieces comprises a threaded nut to secure the connection.

Clause 20: The system of clause 14, wherein the first locking structure comprises a first, bottom flange comprising anchor holes and the second locking structure comprises a second, bottom flange comprising anchor holes, wherein the first, bottom flange comprising anchor holes and the second, bottom flange comprising anchor holes are configured to receive anchors.

Clause 21: The system of clause 1, further comprising ground anchors that limit separation between the first pathway segment and the second pathway segment and provides lateral restraint for first and second edge supports.

Clause 22: The system of clause 1, wherein the second joint is configured to allow the second elevated platform to be positioned relative to the first pathway segment creating a pathway that follows the vertical profile grade of the ground.

Clause 23: The system of clause 1, wherein materials of the first pathway segment and the second pathway segment comprise one or more of a polymeric material, a glass fiber reinforcing, a carbon fiber reinforcing, a basalt fiber reinforcing, a ferrous metal material, or an aluminum material.

Clause 24: The system of clause 1, further comprising: a guiderail connected to the first and second elevated platforms.

Clause 25: The system of clause 24, wherein the guiderail is secured to at least one of the first or second elevated platforms.

Clause 26: The system of clause 1, wherein the first joint comprises hemispherical cylinder studs configured in an alternating pattern to limit relative movement between the first pathway segment and the second pathway segment.

Clause 27: The system of clause 26, wherein the first joint of the first pathway segment mates with the second joint of the second pathway segment.

Clause 28: The system of clause 27, wherein when the first joint is mated to the second joint, the first and second joint allow the first pathway segments and the second pathway segment to follow a vertical profile grade of the ground.

Clause 29: The system of any of clauses 26-28, wherein the pattern of the hemispherical cylinder studs alternate in a 3-stud, 1-stud series.

Clause 30: The system of any of clauses 26-29, wherein the hemispherical cylinder stud pattern of the first joint of the first pathway segment is opposite hand of the first joint of the second pathway segment.

Clause 31: The system of any of clauses 26-30, wherein a row of hemispherical cylinder studs are vertically aligned such that either two of the 3-stud configuration, or the 1-stud configuration is flush with the top of the deck.

Clause 32: The system of clause 31, wherein the hemispherical portion of a stud has a radius equal to the length of the cylindrical portion of a stud.

Clause 33: The system of clauses 1-32, wherein the system is configured to act as formwork for the construction of the paving material of the pathway while the TPES is in service.

Clause 34: The system of clauses 1-33, wherein the system comprises screeds to finish the pathway paving material while the TPES is in service.

Clause 35: The system of clauses 1-34, wherein the system comprises material conveyance to allow placement of the pathway paving material while the TPES is in service.

Various examples have been described. These and other examples are within the scope of the following claims.

What is claimed is:

1. A modular system for constructing an elevated pathway, the system comprising:

a first pathway segment comprising:

a first elevated platform portion;

first edge supports configured to bare a load of the first elevated platform portion, wherein the first edge supports are configured to contact a ground surface and to create a grade separation between the ground surface and a bottom side of the first elevated platform portion;

a first joint;

a second pathway segment comprising:

a second elevated platform portion;

second edge supports configured to bare a load of the second elevated platform portion, wherein the second edge supports are configured to contact the ground surface and to create a grade separation between the ground surface and a bottom side of the second elevated platform portion;

a second joint configured to attach to the first joint to limit a motion of the second pathway segment relative to the first pathway segment.

2. The system of claim 1, wherein the second edge supports are configured to straddle a structure under the bottom side of the second elevated platform portion without contacting the structure.

3. The system of claim 1, wherein the second joint is configured to transfer a portion of the load of the second elevated platform portion to the first pathway segment.

4. The system of claim 1, further comprising:

a third pathway segment comprising:

a third elevated platform portion;

third edge supports configured to bare a load of the third elevated platform portion, wherein the third edge supports are configured to contact the ground surface and to create a grade separation between the ground surface and a bottom side of the third elevated platform portion;

a third joint configured to attach to the second pathway segment to limit a motion of the third pathway segment relative to the second pathway segment.

5. The system of claim 4, wherein a first side of the third elevated platform is longer than a second side of the third elevated platform, such that the third elevated platform causes the contiguous pathway to be non-straight.

6. The system of claim 4, wherein:

a top side of the first elevated platform portion slopes towards the ground surface;

a top side of the second elevated platform portion is approximately parallel to the ground surface; and a top side of the third elevated platform portion slopes towards the ground the surface.

7. The system of claim 1, wherein a top side of the first elevated platform portion is angled relative to the ground surface.

8. The system of claim 1, wherein the second pathway segment further comprises:

openings in a top side of the first elevated platform, wherein the openings are configured to allow water into a chamber that carries the water to one or more drainage holes.

9. The system of claim 1, wherein the segment joint captures water penetrating the joint and conveys and release the water to an outer or inner side of the pathway.

10. The system of claim 1, wherein the first pathway segment comprises a first locking structure and the second pathway segment comprises a second locking structure, wherein the first locking structure is configured to secure the first locking structure to the second locking structure.

11. The system of claim 1, further comprising ground anchors that limit separation between the first pathway segment and the second pathway segment and provides lateral restraint for first and second edge supports.

12. The system of claim 1, wherein the second joint is configured to allow the second elevated platform to be positioned relative to the first pathway segment creating a pathway that follows the vertical profile grade of the ground surface.

13. The system of claim 1, wherein materials of the first pathway segment and the second pathway segment comprise one or more of a polymeric material, a glass fiber reinforcing, a carbon fiber reinforcing, a basalt fiber reinforcing, a ferrous metal material, or an aluminum material.

14. The system of claim 1, further comprising:

a guiderail connected to the first and second elevated platforms, wherein the guiderail is secured to at least one of the first or second elevated platforms.

15. The system of claim 1, wherein the first pathway segment comprises multiple sub-segments allowing variations in ramp slopes and ramp segment lengths.

16. The system of claim 1, wherein the first joint comprises a rounded male finger extending along the mating edge of the deck to limit relative movement between the first pathway segment and the second pathway segment.

17. The system of claim 1, wherein the second joint comprises a rounded female slot extending along the mating edge of the deck to limit relative movement between the second pathway segment to the first pathway segment.

18. The system of claim 1, wherein the first joint of the first pathway segment mates with the second joint of the second pathway segment.

19. The system of claim 1, wherein when the first joint is mated to the second joint, the first and second joint allow the first pathway segments and the second pathway segment to follow a vertical profile grade of the ground surface.

20. The system of claim 1, wherein the first and second joints are configured to limit the relative range of motion of the first pathway segment and the second pathway segment.

* * * * *